US010781625B2

(12) United States Patent
Estill et al.

(10) Patent No.: US 10,781,625 B2
(45) Date of Patent: Sep. 22, 2020

(54) SAFE CONFIGURED FOR HOLDING VALUABLES

(71) Applicant: Danby Products Limited, Guelph (CA)

(72) Inventors: Jim Estill, Guelph (CA); Gregory Allan Thomas Hall, Guelph (CA); Bryan Stuart Cunningham, Kitchener (CA)

(73) Assignee: INTIRION CORPORATION, Walpole, MA (US)

( * ) Notice: Subject to any disclaimer, the term of this patent is extended or adjusted under 35 U.S.C. 154(b) by 190 days.

(21) Appl. No.: 15/951,525

(22) Filed: Apr. 12, 2018

(65) Prior Publication Data

US 2019/0316406 A1 Oct. 17, 2019

Related U.S. Application Data

(63) Continuation-in-part of application No. 15/239,378, filed on Aug. 17, 2016, now abandoned.

(60) Provisional application No. 62/262,954, filed on Dec. 4, 2015, provisional application No. 62/211,765, filed on Aug. 29, 2015.

(51) Int. Cl.

| | |
|---|---|
| ***E05G 1/024*** | (2006.01) |
| ***E05G 1/04*** | (2006.01) |
| ***E05G 1/10*** | (2006.01) |
| ***E05B 37/00*** | (2006.01) |
| *E05D 7/14* | (2006.01) |

(52) U.S. Cl.

CPC ..... *E05G 1/024* (2013.01); *E05B 37/00* (2013.01); *E05G 1/04* (2013.01); *E05G 1/10* (2013.01); *E05D 7/14* (2013.01)

(58) Field of Classification Search

CPC .. E05G 1/00; E05G 1/02; E05G 1/024; E05G 1/026; E05G 1/04

See application file for complete search history.

(56) References Cited

U.S. PATENT DOCUMENTS

| | | | | |
|---|---|---|---|---|
| 2,144,136 A | | 1/1939 | Albach | |
| 3,065,038 A | | 11/1962 | Pipe | |
| 3,101,226 A | * | 8/1963 | Cochran, Jr. | A47B 47/03 312/265.5 |
| 3,360,321 A | * | 12/1967 | Novales | A47B 87/005 312/257.1 |
| 3,563,624 A | | 2/1971 | Stice | |
| 4,426,935 A | | 1/1984 | Nikoden, Jr. | |
| 4,559,881 A | * | 12/1985 | Lankard | B28B 23/00 106/644 |
| 5,570,940 A | | 11/1996 | Maro | |
| 5,724,774 A | * | 3/1998 | Rooney | E04B 1/34321 52/79.5 |

(Continued)

FOREIGN PATENT DOCUMENTS

| | | |
|---|---|---|
| DE | 2300675 A1 | 7/1974 |
| GB | 2269313 A | 2/1994 |

*Primary Examiner* — Christopher J Boswell

(74) *Attorney, Agent, or Firm* — Ralph E. Jocke; Colin P. Cochran; Walker & Jocke

(57) ABSTRACT

A safe configured for holding valuables (137) includes a safe body (141) which bounds an interior area (270). The safe body is comprised of a plurality of engageable panels. A door (272) is releasable engageable with the body. The door includes a lock (284) that is changeable between locked and unlocked conditions.

28 Claims, 24 Drawing Sheets

(56) References Cited

U.S. PATENT DOCUMENTS

| | | | | |
|---|---|---|---|---|
| 5,960,592 | A * | 10/1999 | Lilienthal, II | E04H 1/1238 52/745.02 |
| 6,113,203 | A * | 9/2000 | Chen | A47B 43/00 312/258 |
| 6,478,391 | B1 | 11/2002 | Stoever | |
| 6,561,601 | B1 | 5/2003 | Maffeo | |
| 6,786,009 | B1 | 9/2004 | McGunn et al. | |
| 7,350,470 | B1 | 4/2008 | Stuhlbarg et al. | |
| 7,661,375 | B2 | 2/2010 | McCarthy et al. | |
| 8,042,890 | B2 | 10/2011 | Collins et al. | |
| 8,742,304 | B2 | 6/2014 | Emma | |
| 9,752,372 | B2 * | 9/2017 | Arendsee | B65D 85/68 |
| 2006/0060114 | A1 | 3/2006 | Walker | |
| 2006/0108899 | A1 * | 5/2006 | Jin | A47B 43/00 312/257.1 |
| 2006/0254796 | A1 | 11/2006 | Chen | |
| 2008/0035035 | A1 | 2/2008 | Stone | |
| 2010/0282136 | A1 * | 11/2010 | Stanley | E05G 1/005 109/64 |
| 2012/0085272 | A1 | 4/2012 | Chow | |
| 2012/0242200 | A1 | 9/2012 | Keragala | |
| 2013/0264338 | A1 * | 10/2013 | Dunstan | B65D 7/32 220/4.33 |
| 2017/0059233 | A1 | 3/2017 | Estill et al. | |
| 2017/0174390 | A1 * | 6/2017 | Clark | E05G 1/005 |

* cited by examiner

SAFE CONFIGURED FOR HOLDING VALUABLES

TECHNICAL FIELD

Exemplary embodiments relate to safes configured to hold valuable items which may be classified in US class 109, subclass 58; CPC E05G 1/00.

BACKGROUND

Individuals often need to store valuable items so that they cannot be stolen. Various forms of safes or other secure containers may be utilized for purposes of storing such items and limiting access to such items to only authorized persons. Such safes may include a body bounding an interior area. The body may include an access opening to the interior area. A safe door movably mounted in operative connection with the body may be configured to close the access opening. One or more locks may be in operative connection with the body and the door so that in the locked condition of the lock, the door is held in a closed position which prevents access to the interior area by unauthorized persons. The lock may be changed by authorized persons to an unlocked condition which enables the door to be moved from the closed position to an open position, in which the interior area of the safe and the valuables that have been stored therein may be accessed.

Safes must be able to withstand various forms of attack by unauthorized persons who attempt to gain access to the interior area and the valuables therein. Safes may benefit from improvements.

SUMMARY

Exemplary embodiments include a safe that may be utilized to hold valuable items and prevent access thereto by unauthorized persons. Exemplary embodiments include a safe including a body. The body bounds and interior area in which valuable items may be stored. The exemplary body is comprised of a plurality of wall panels that are assembled in interengaged relation.

The exemplary safe further includes a door. The door is releasably movably mounted in connection with the body. The door is sized for closing an access opening to the interior area of the body in a closed position of the door. The door is movable from the closed position to an open position in which the door is sufficiently disposed from the access opening to enable access to the interior area from outside the safe. The door includes a lock. In a locked condition of the lock a bolt of the lock is operative to engage a strike opening within the safe so as to hold the door in the closed position. The exemplary lock is enabled to be changed through appropriate manual inputs from the locked condition to an unlocked condition. In the unlocked condition of the lock, the bolt is retractable from engagement with the strike opening and the door is enabled to be moved from the closed position to the open position.

Exemplary embodiments provide a safe that is suitable for holding valuable items and resisting attempts by unauthorized persons to access the interior area. Exemplary embodiments further provide giving alarm indications when attempts are made to compromise the integrity of the safe body or to move the safe. Further features of the exemplary embodiments are described in the following Detailed Description.

DETAILED DESCRIPTION

Figure 1:
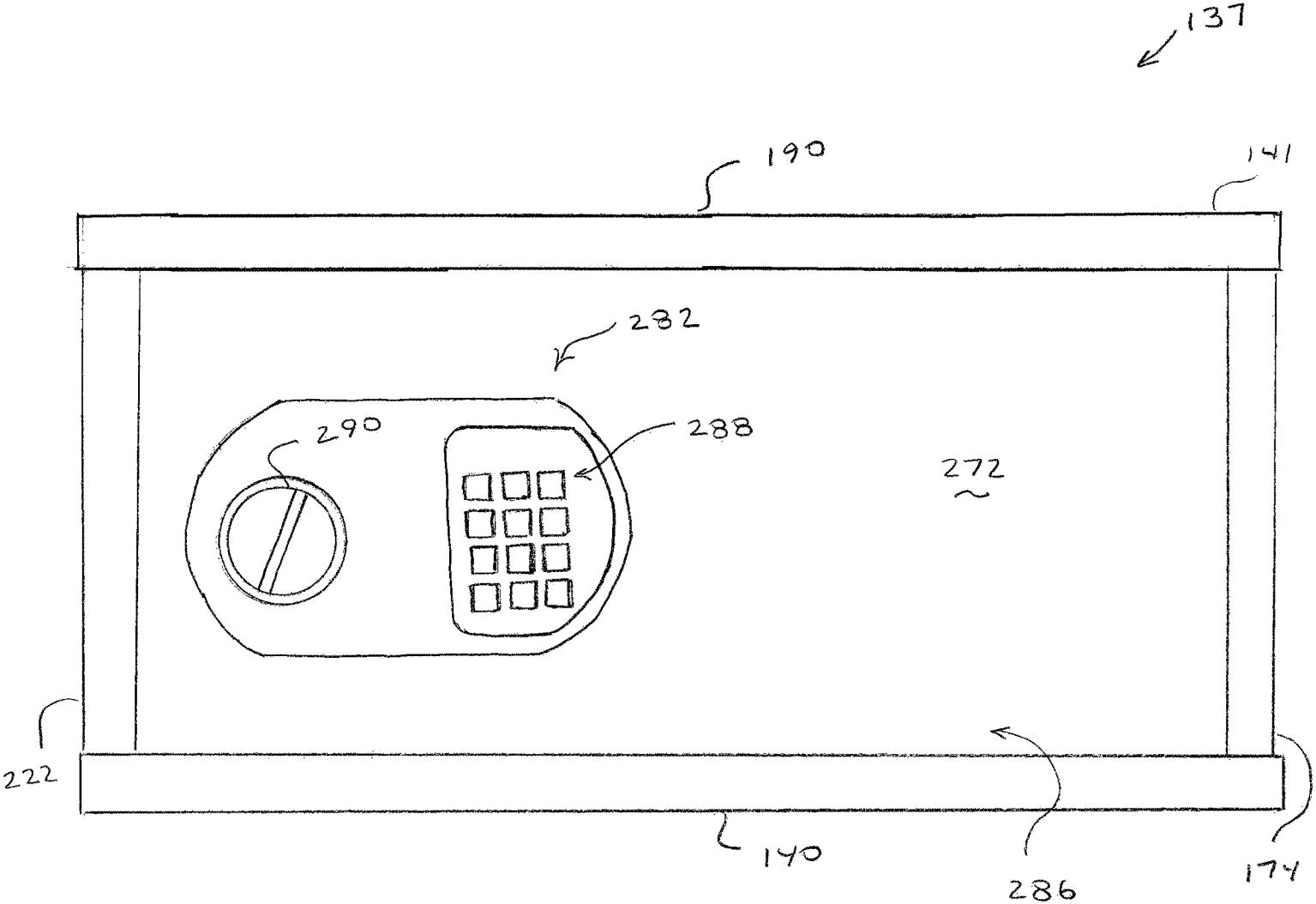
FIG. 1 is a front plan view of an exemplary embodiment of a safe used for holding valuable items.

Referring now to the drawings and particularly to FIG. 1 there is shown therein an exemplary safe 137. Safe 137 is configured for holding valuable items which a user does not wish unauthorized persons to gain access to. Such valuable items may include money, jewelry, watches, credit or debit cards, a smart phone, car keys, house keys or other valuables that a person wishes to secure.

The exemplary safe 137 includes a body 141. The exemplary body 141 is comprised of a plurality of wall pieces. The wall pieces include a bottom wall piece 140 and a top wall piece 190. The exemplary wall pieces further include a side wall piece 174 and a side wall piece 222. The exemplary body further includes a back wall piece 260 (see FIG. 13). The wall pieces bound an interior area 270. The exemplary body 141 includes an access opening 286 to the interior area which is on an opposed side of the body from the back wall piece. A door 272 is movably mounted in operative connection with the body 141 in a manner hereinafter discussed. The door is sized to close the access opening 286 in a closed position of the door. The door is movable relative to the body so as to be at least partially disposed from the access opening in an open position of the door. In the open position of the door 272, the interior area 270 and the valuables stored therein are accessible from outside the body 141.

The exemplary door 272 includes an exemplary user interface 282. The exemplary user interface includes a user input device 288. The exemplary user input device includes a keypad into which a user may input a combination, code or other series of inputs. When a predetermined combination is input through the input device 288, a lock 284 that is in operative connection with the door is enabled to be changed from a locked condition in which the lock is operative to hold the door in a closed position, to an unlocked condition in which the door is enabled to be moved from the closed position to the open position. The exemplary user interface 282 further includes a knob 290. The knob 290 is usable to manually move a bolt associated with the lock when the lock is in an unlocked condition as hereinafter discussed.

In the exemplary embodiment, the components which make up the safe prior to assembly are capable of being stored and shipped as a plurality of stacked planar components. This enables the components to be transported in a disassembled condition in a compact package. In the exemplary embodiment, at a point of assembly the components which make up the safe are connected in fixed connection through engagement either without tools or in some situations through the use of minimal common hand tools. However, the exemplary arrangement provides that once the components of the safe have been engaged, the components are secured to provide resistance to disassembly and intrusion into the interior area of the safe.

Figure 2:
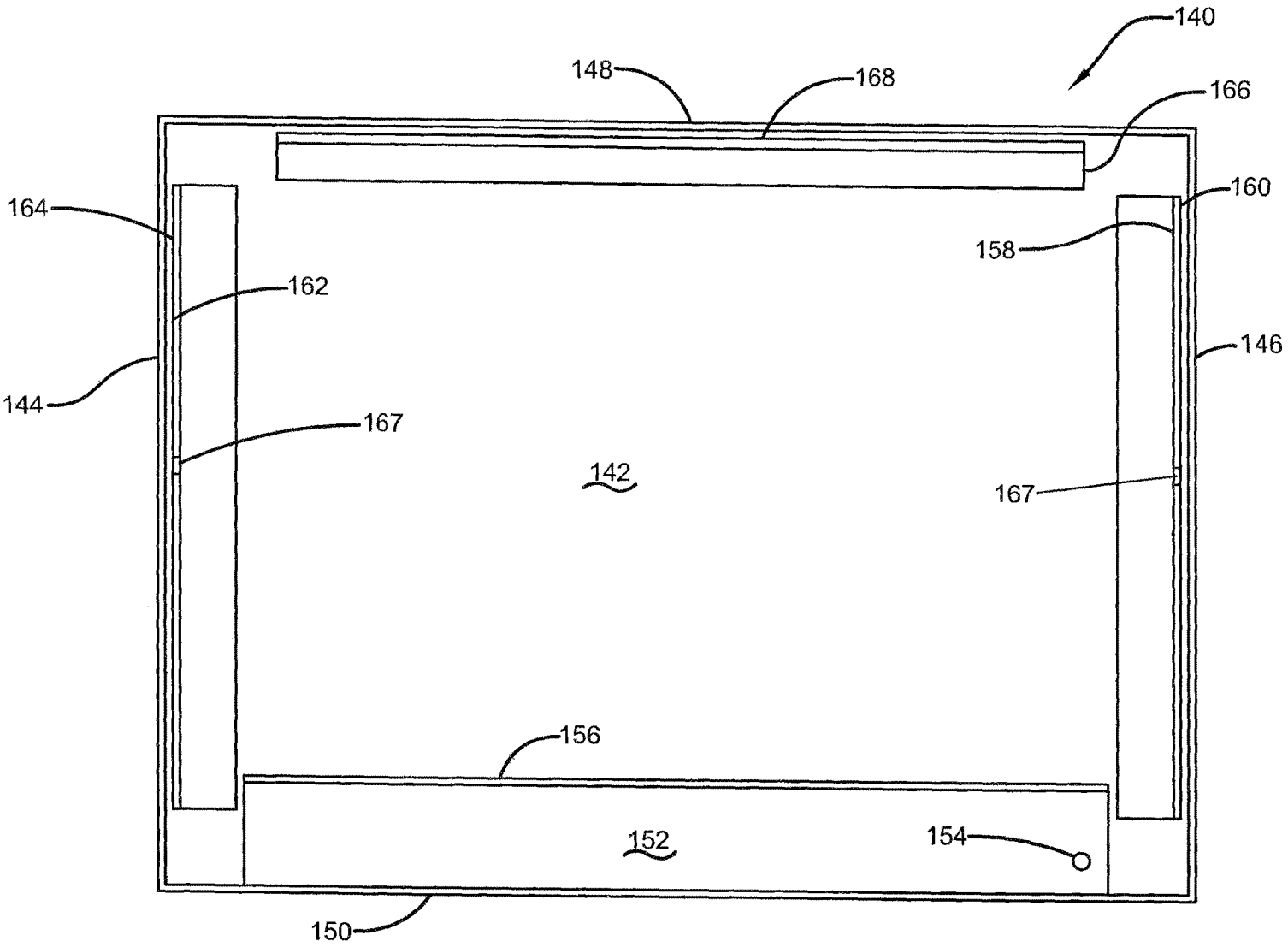
FIG. 2 is a top plan view of an exemplary bottom wall piece of a body of the exemplary safe.

FIG. 2 shows a top plan view of an exemplary bottom wall piece 140 of the exemplary safe 137. The bottom wall piece includes a bottom plate 142. The bottom wall piece 140 further includes an outer bounding side wall segment 144. The outer bounding side wall segment 144 extends generally perpendicular to the bottom plate 142. An outer bounding side wall segment 146 extends on an opposed side of the bottom wall piece from side wall segment 144.

The bottom wall piece 140 further includes an outer bounding back wall segment 148. The back wall segment 148 extends generally perpendicular to the side wall segments 144 and 146. A front wall segment 150 extends on the bottom wall piece at a side opposite back wall segment 148. A bottom shelf 152 extends horizontally inward from the front wall segment 150 when the bottom plate extends horizontal. The bottom shelf 152 includes a bottom hinge pin opening 154 therein. The bottom shelf 152 further includes a bottom turned edge 156. The bottom turned edge 156 as later explained serves as an upward extending stop for the safe door 272 when in the closed position. In the exemplary arrangement, the bottom turned edge extends generally the entire width of the bottom shelf 152 which as later described generally corresponds to the entire width of the access opening to the interior area 270 of the safe.

The exemplary bottom wall piece includes an upward engaging side wall segment 158. In the exemplary arrangement, the engaging side wall segment includes a leg of an angle piece that is fastened to the bottom plate 142. The engaging side wall segment 158 is disposed inwardly from and parallel to the adjacent outer bounding side wall segment such that the engaging side wall segment 158 and the outer bounding side wall segment define an elongated side slot 160 therebetween. An engaging side wall segment 162 extends adjacent to outer bounding side wall segment 144 so as to define an elongated side slot 164 at the opposite side of the bottom wall piece from side slot 160.

An engaging back wall segment 166 is disposed inwardly and adjacent to outer bounding back wall segment 148. Back wall segment 148 and engaging wall segment 166 define a back slot 168.

Figure 3:
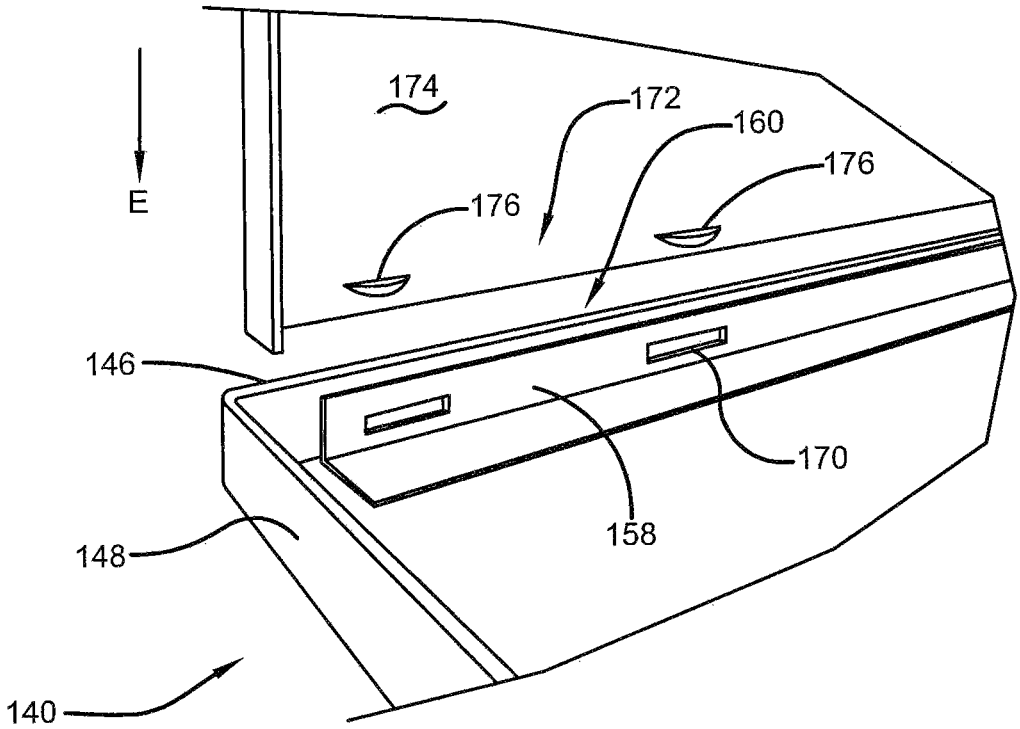
FIG. 3 is an isometric view representing how wall pieces of the exemplary safe body are held in engagement through resilient spring tabs and recesses.
Figure 4:
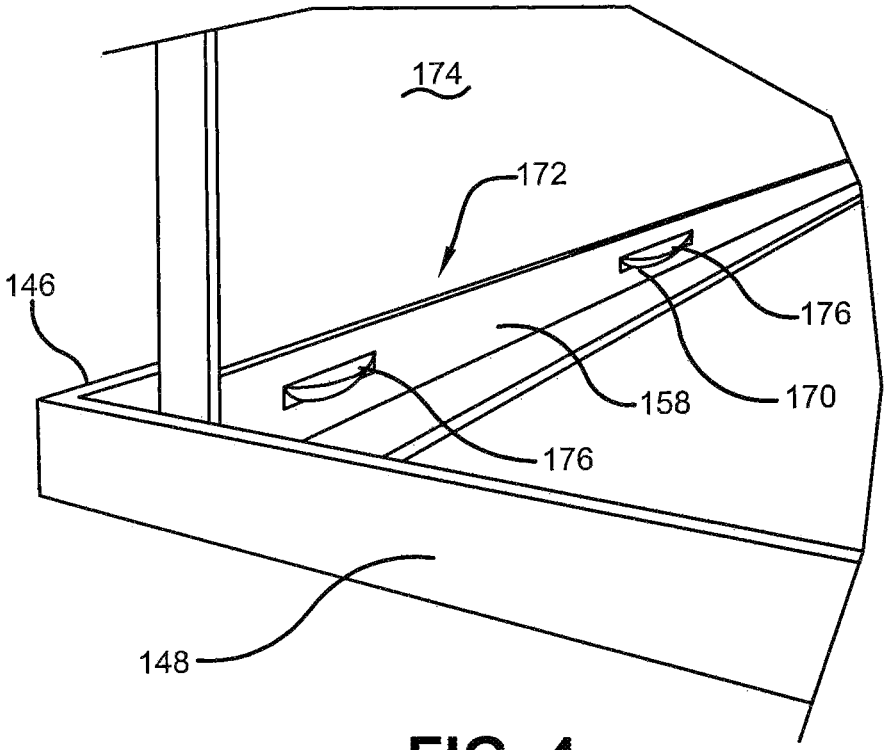
FIG. 4 is a view similar to FIG. 3 with the tabs and the recesses in engagement.

In an exemplary embodiment each of the engaging wall segments include recesses 170 as shown in FIG. 4. The side wall pieces as later discussed, each include a latching edge portion 172 at both the top and the bottom of the side wall piece. Only the latching edge portion at the bottom of the hinge side piece 174 is shown in FIG. 3. The latching edge portion 172 is configured to be engaged in an elongated slot such as side slot 160 shown in FIG. 3.

In the exemplary embodiment, the side wall pieces such as side wall piece 174 include a plurality of resilient spring tabs 176 thereon. The positions of the tabs correspond to the positions of the recesses of the engaging wall segment when the pieces are assembled.

In the exemplary embodiment, the bottom wall piece includes apertures 167 that extend through each of engaging side wall segments 158 and 162. In the exemplary arrangement, the apertures 167 are configured for receiving a respective releasable fastener such as a pin, thumb screw or a machine screw. The releasable fasteners are used to further hold side wall pieces in engagement with the bottom wall piece as later described in detail.

Figure 5:
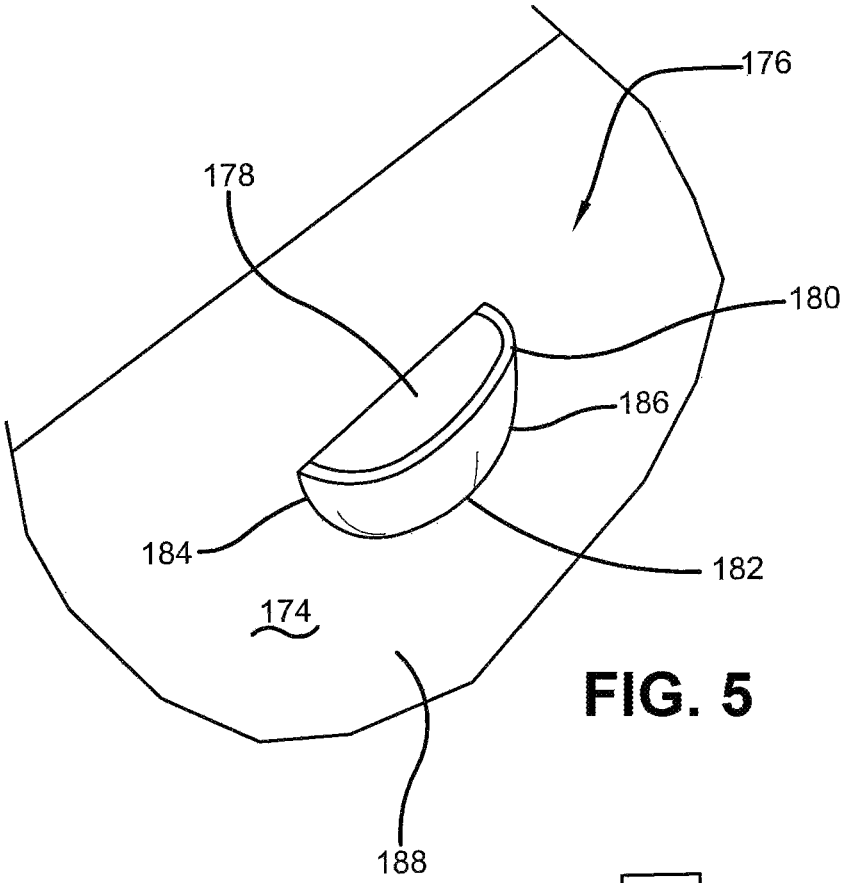
FIG. 5 is a top isometric view of an exemplary resilient spring tab.
Figure 6:
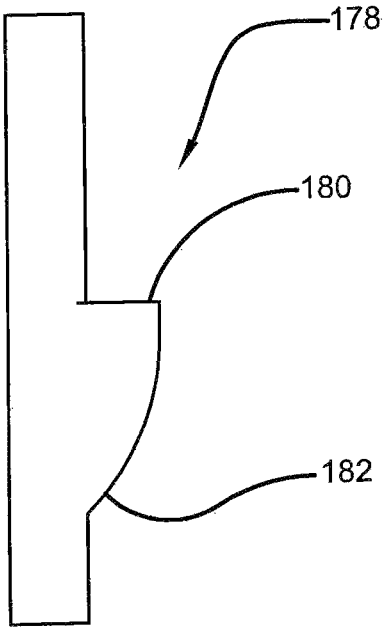
FIG. 6 is a side view of an exemplary tab.
Figure 7:
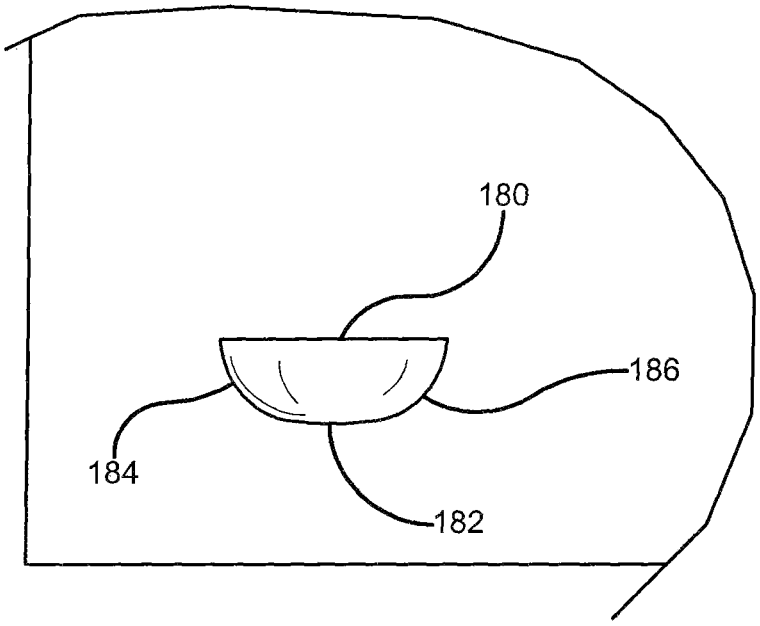
FIG. 7 is a front view of an exemplary resilient spring tab.

The exemplary resilient spring tab 176 comprises a punched opening in the latching edge portion of the planar wall portion of the side wall piece. As shown in FIGS. 5-7, tabs 176 of an exemplary embodiment include an opening 178 that extends generally perpendicular to the planar wall of the side wall piece 174. The exemplary tab includes a catch surface 180 at a first end that is sheared and disposed away from the surrounding planar metal wall surface.

The exemplary resilient spring tab 176 further includes a smooth rounded second end 182 opposite of the catch surface 180. The tabs 176 further include smooth rounded sides 184 and 186. The smooth second end and rounded sides of the exemplary tab are continuous with the adjacent wall surface such as the inner surface 188 of side wall piece 174.

Figure 8:
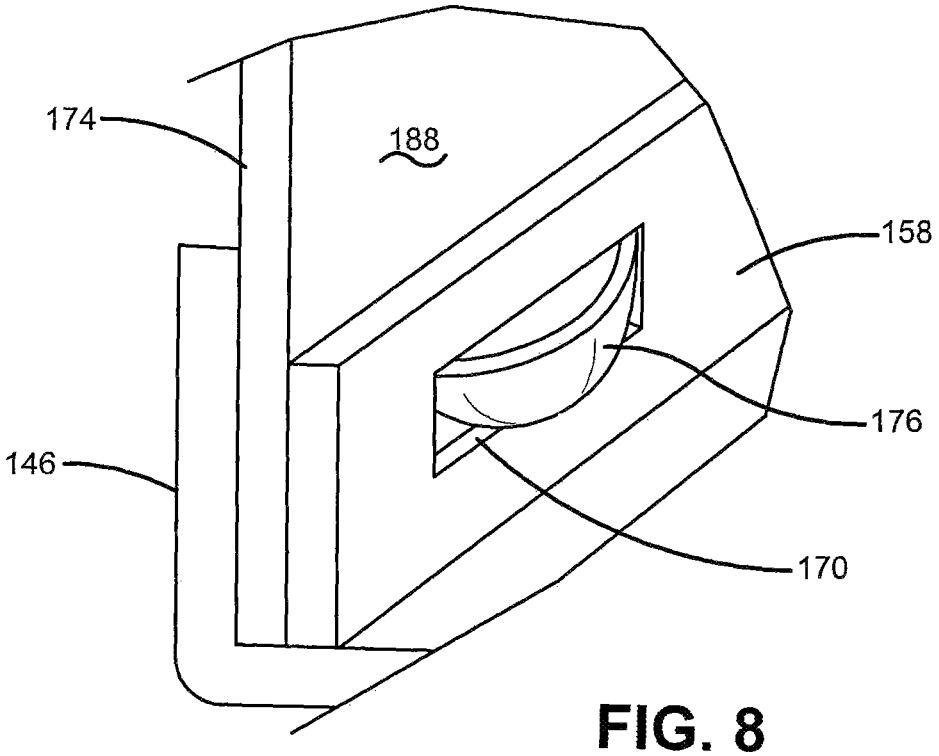
FIG. 8 is an isometric view of an exemplary resilient spring tab engaged in a recess.

In the exemplary arrangement, the engagement of the bottom wall piece 140 and side wall piece 174 is accomplished by moving the side wall piece 174 in the direction of Arrow E relative to the bottom wall piece 140. This causes the resilient spring tabs to deform and also deform the engaging wall segment until the tabs move into the slot 160 and into the recesses 170 of the engaging wall segment 158. Such engagement is represented in FIGS. 4 and 8. Once the tabs are in engagement with the recesses, the bottom wall piece and side wall piece return to the undeformed configurations and are in firmly fixed engagement as the catch surface 180 is in abutting relation with the adjacent surface bounding the recess. This securely engages the pieces together and reduces the risk of the pieces being separated by prying or other attack methods.

While in the exemplary embodiment, the latching edge portions which extend in the slots include the tabs, and the engaging side wall segments include recesses for engaging the tabs, in other arrangements, this configuration may be reversed. For example, the engaging side wall segments may include tabs which engage recesses in the latching edge portions of the adjacent wall pieces. Alternatively each piece may include some tabs and some recesses which engage when the pieces are assembled. Of course it should be understood that the configuration of the exemplary tabs and recesses are exemplary of interengaging projections and recesses that may be used.

Further, while the exemplary arrangement is configured to enable assembly through manual engagement of wall pieces either without tools or with minimal use of tools, other arrangements utilizing similar principles may utilize conventional fasteners or other devices for holding wall pieces in engagement. It will be appreciated that numerous different engaging configurations may be utilized along with the principles that are described herein.

Figure 9:
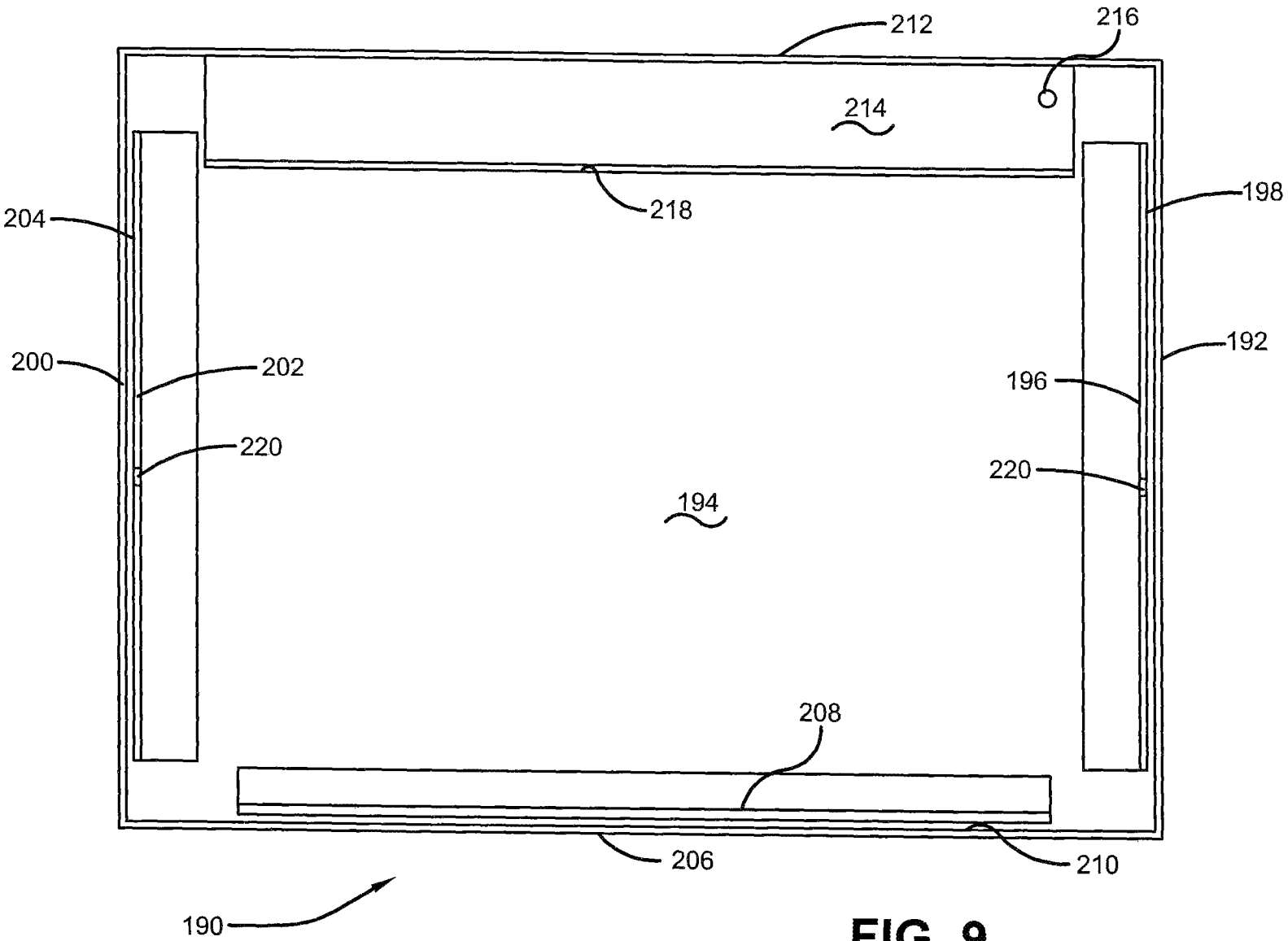
FIG. 9 is a bottom plan view of an exemplary top wall piece of the safe body.

In the exemplary safe 137 having the construction described herein, the safe includes a top wall piece 190 shown in FIG. 9. In the exemplary embodiment, the top wall piece 190 is generally the mirror image of bottom wall piece 140. The top wall piece 190 includes outer top bounding wall side segment 192 which is turned generally perpendicular to a top plate 194. An engaging side wall segment 196 is disposed adjacent to wall segment 192 and defines a top side slot 198. Similarly, top wall piece 190 has a bounding top side wall segment 200 at a side opposite top side wall segment 192. An engaging side wall segment 202 is adjacent to top side wall segment 200 and defines a top side slot 204.

Exemplary top wall piece 190 further includes a bounding top back wall segment 206. An engaging back wall segment 208 is adjacent to segment 206 and defines a back top slot 210.

Similar to bottom wall piece 140, top wall piece 190 includes a front wall segment 212 that in the assembled condition and in the operative position of the safe 137 extends downward from the top plate 194 and bounds the access opening to the interior area 270 of the safe. A top shelf 214 extends inward from the front wall segment 212 and includes a top hinge pin opening 216. Top hinge pin opening 216 is configured to accept a hinge pin therein associated with the safe door 272 as later described. The exemplary top shelf 214 includes a top turned edge 218. The top turned edge extends perpendicular to the shelf 214 in the operative position of the safe and provides a downward extending stop. The downward extending stop engages the interior side of safe door 272 in a closed position and prevents the safe door from moving further into the interior area 270 of the safe 137 beyond the closed position. In the exemplary embodiment, the top turned edge 218 extends substantially the entire width of the access opening 286 into the interior area of the safe.

Similar to bottom wall piece 140, the top wall piece 190 includes apertures 220 that extend in each of engaging side wall segments 196 and 202. Apertures 220 are configured to receive releasable fasteners therein to further engage the top wall piece with side wall pieces of the safe. Of course it should be understood that these configurations are exemplary and in other embodiments, other approaches may be used.

Figure 10:
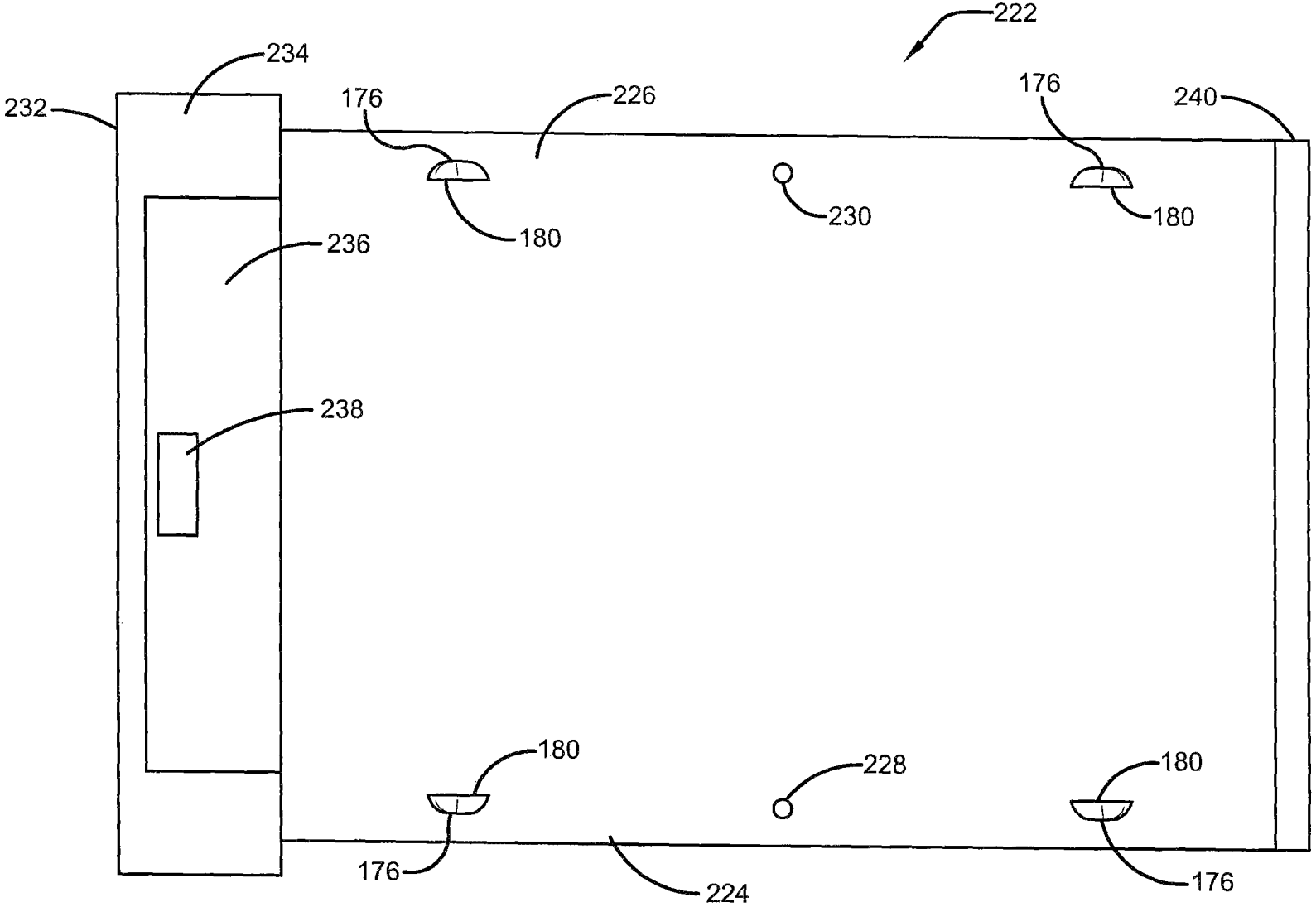
FIG. 10 is a top isometric view of a side wall piece of the exemplary safe body including a strike and a strike opening.

FIG. 10 shows an exemplary side wall piece 222. Side wall piece 222 is a strike side wall of the exemplary safe construction which includes the strike that engages a bolt of a lock on the safe door 272 to hold the safe door in a closed position, as later described.

The exemplary side wall piece 222 includes a bottom latching edge portion 224. The bottom latching edge portion 224 is configured to engage in side slot 164 of the bottom wall piece 140. The bottom latching edge portion 224 includes resilient spring tabs 176. The tabs 176 have their catch surfaces 180 facing away from the bottom edge portion 224.

Side wall piece 222 further includes a top latching edge portion 226. The top latching edge portion 226 is configured to extend in top side slot 204 of top wall piece 190. The top latching edge portion 226 includes tabs 176 as shown with the catch surfaces 180 thereof facing downward as shown when the safe body 141 is assembled. Side wall piece 222 further includes apertures 228, 230 in the latching edge portions 224 and 226 respectively. Apertures 228 and 230 are used in an exemplary embodiment to hold the wall pieces in engaged relation once the wall pieces have been assembled.

Side wall piece 222 further includes a front facing portion 232. Front facing portion 232 in the assembled condition of the safe bounds the side of the access opening. An inward extending portion 234 extends inward from the front facing portion. The inward extending portion extends inward toward the interior area 270 of the safe and has a configuration that reduces the risk that prying tools can be extended behind the safe door when the door is in a closed position.

Figure 11:
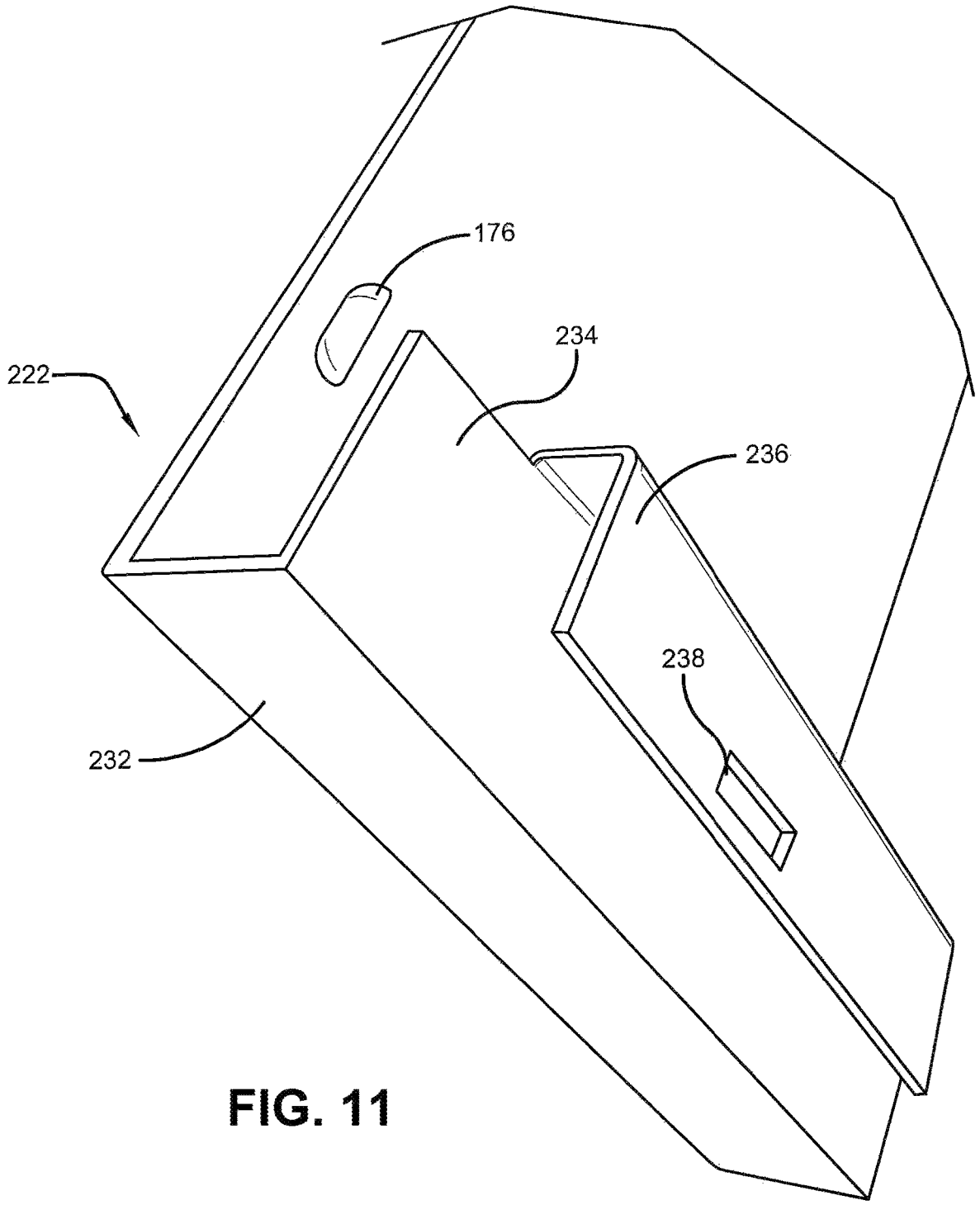
FIG. 11 is a top right isometric view of the side wall piece of the safe body shown in FIG. 10.

As shown in FIG. 11, an L-shaped strike 236 extends from the inward extending portion 234. The strike 236 includes a forward extending portion that is disposed sideways from and generally parallel to the inward extending portion 234. The strike 236 includes a strike opening 238. As later explained in detail, the strike opening 238 is sized to accept a retractable bolt associated with a lock of the door of the safe. When the bolt is in extended engagement with the strike opening 238, the safe door is held secured in a closed position.

The exemplary side wall piece 222 further includes an inturned back portion 240. The inturned back portion serves to close the back side of the safe enclosure and mate in abutting relation with a back wall piece in a manner later described.

Figure 12:
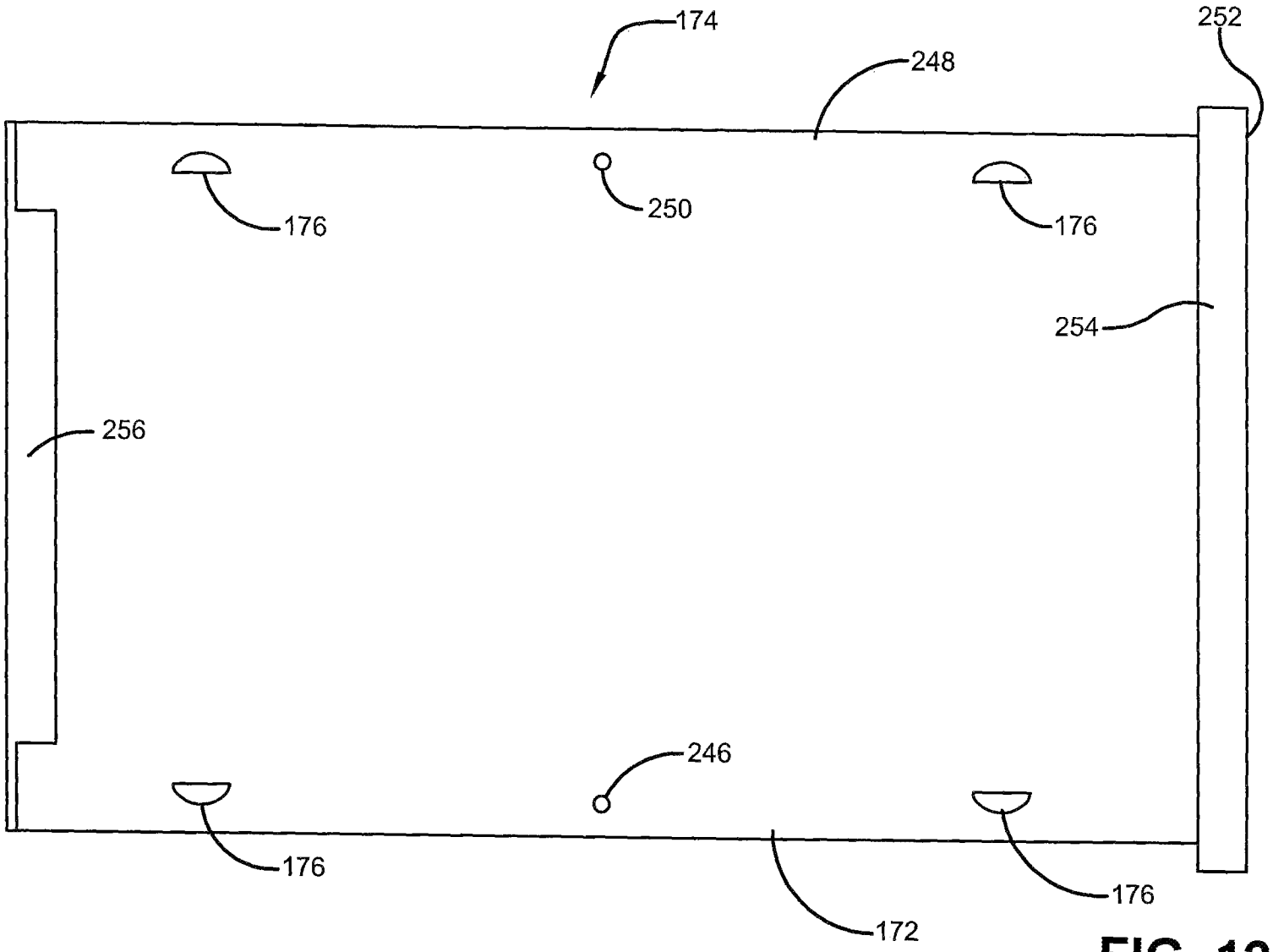
FIG. 12 is a top isometric view of a side wall piece that extends on a hinge side of the exemplary safe body.
Figure 14:
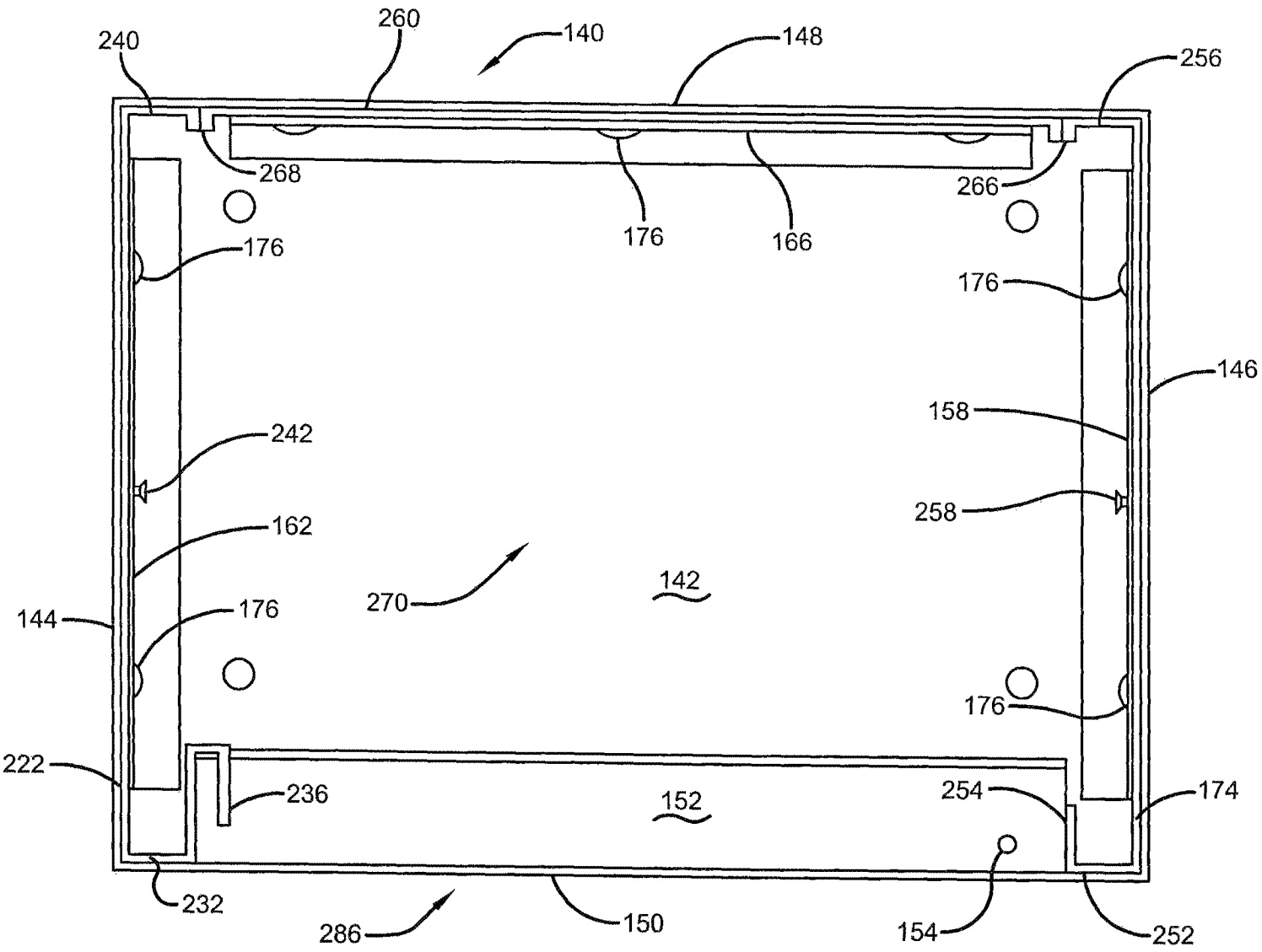
FIG. 14 is a top plan view of the bottom wall piece, two side wall pieces and back wall piece of the exemplary safe body in an assembled condition.
Figure 15:
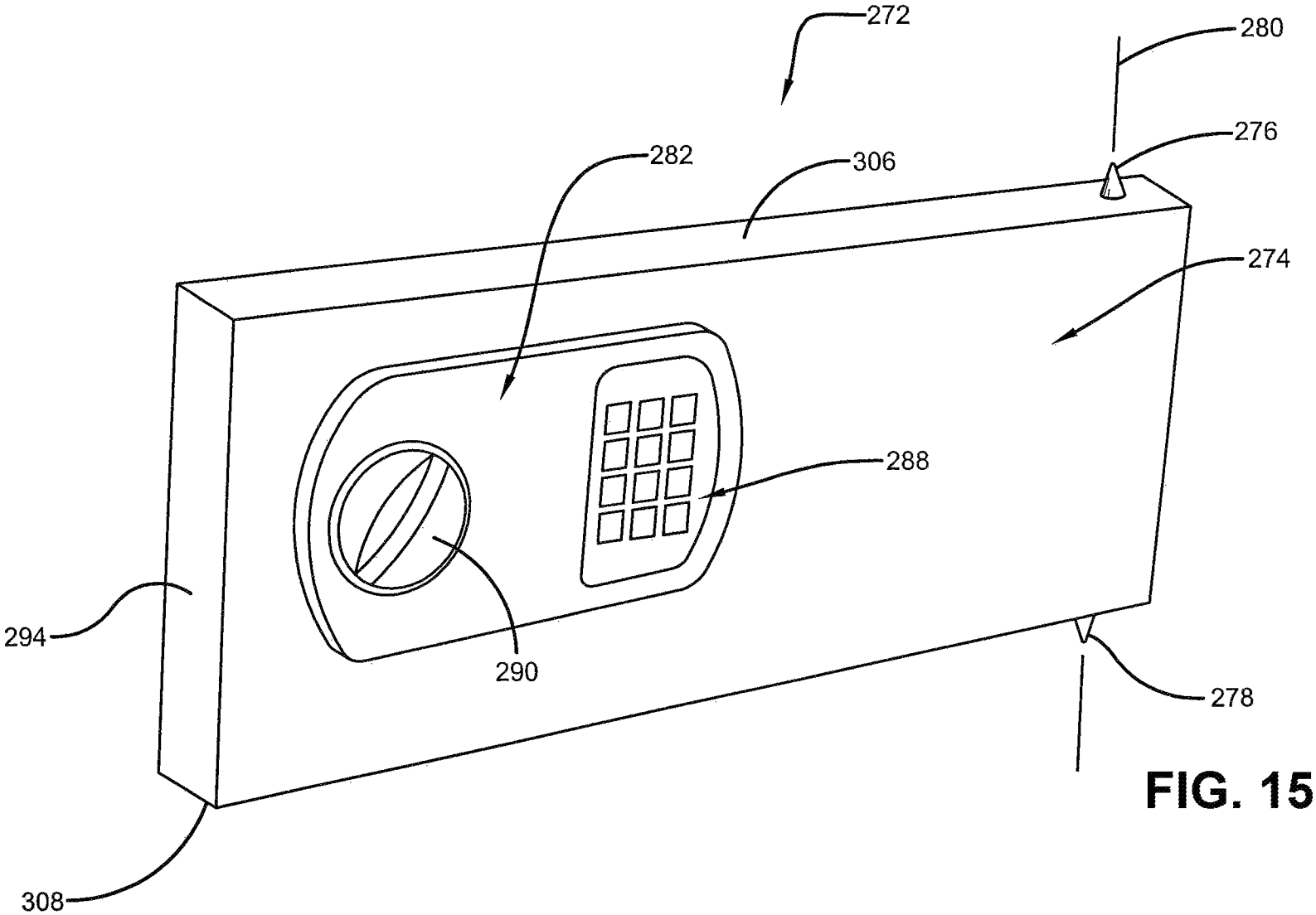
FIG. 15 is a front right isometric view of the door of the exemplary safe.

FIG. 12 shows a top plan view of the bottom wall piece 140 in engaged relation with the side wall piece 222. As shown in the assembled position, the resilient spring tabs 176 on the lower latching edge portion 224 extend in engaged relation with the recesses on engaging side wall segment 162. Also as shown in FIG. 14, a releasable fastener 242 extends in aperture 228 of side wall piece 222 and aperture 167 of engaging side wall segment 162. In the exemplary arrangement, the releasable fastener 242 may include a pin or screw which extends in the apertures. By extending in the apertures, the releasable fastener provides further engagement and resistance to separation of the bottom wall piece 140 and the side wall piece 222. Of course this construction is exemplary and in other embodiments, other approaches may be used.

FIG. 12 shows side wall piece 174 in greater detail. Side wall piece 174 of the exemplary embodiment extends on the hinge side of the safe opposite to strike side wall piece 222.

Side wall piece 174 includes a bottom latching edge portion 172 which is configured to extend in side slot 160 of the bottom wall piece. Latching edge portion 172 includes resilient spring tabs 176 which are configured in a manner similar to that previously described. The bottom latching edge portion 172 further includes an aperture 246. Aperture 246 is configured to be aligned with aperture 167 in engaging side wall segment 158 when in the assembled condition.

Side wall piece 174 further includes an upper latching edge portion 248. Upper latching edge portion 248 is configured to engage top side slot 198 in top wall piece 190. Upper latching edge portion 248 further includes tabs 176 for engaging the recesses in engaging side wall segment 196. Upper latching edge portion 248 further includes an aperture 250. Aperture 250 is configured to be aligned with aperture 220 in engaging side wall segment 196 when in the assembled condition therewith.

Exemplary side wall piece 174 further includes a front facing portion 252. As shown in FIG. 14, the front facing portion 252 faces forward on the container body when the safe 137 is assembled. Front facing portion 252 also bounds the side of the access opening 286 to the interior area 270 of the safe. Side wall piece 174 further includes an inturned portion 254. The inturned portion 254 extends parallel to the main portion of side wall piece 174. Inturned portion 254 extends inward toward the interior area 270 of the safe body 141. In the assembled condition of the body of the safe, the inturned portion 254 serves to help prevent access to the interior area of the safe via pry bars or other burglary tools when the safe door 272 is closed.

Exemplary side wall piece 174 further includes an inturned back portion 256. Inturned back portion 256 closes the back corner of the container body on the side where the side wall piece 174 is positioned. The inturned back portion further includes a leg which is turned back toward the interior area and which is in abutting relation with a back wall piece in the assembled condition of the safe. Of course this configuration is exemplary and in other embodiments, other approaches may be used.

As shown in FIG. 14, a releasable fastener 258 extends in aperture 167 of engaging side wall segment 158 and aperture 246 of side wall piece 174. The fastener further helps to hold the bottom wall piece 140 and the side wall piece 174 in engagement once they have been assembled. The releasable fastener 258 may include a pin, screw or other suitable member for extending between the apertures and preventing relative movement thereof.

Figure 13:
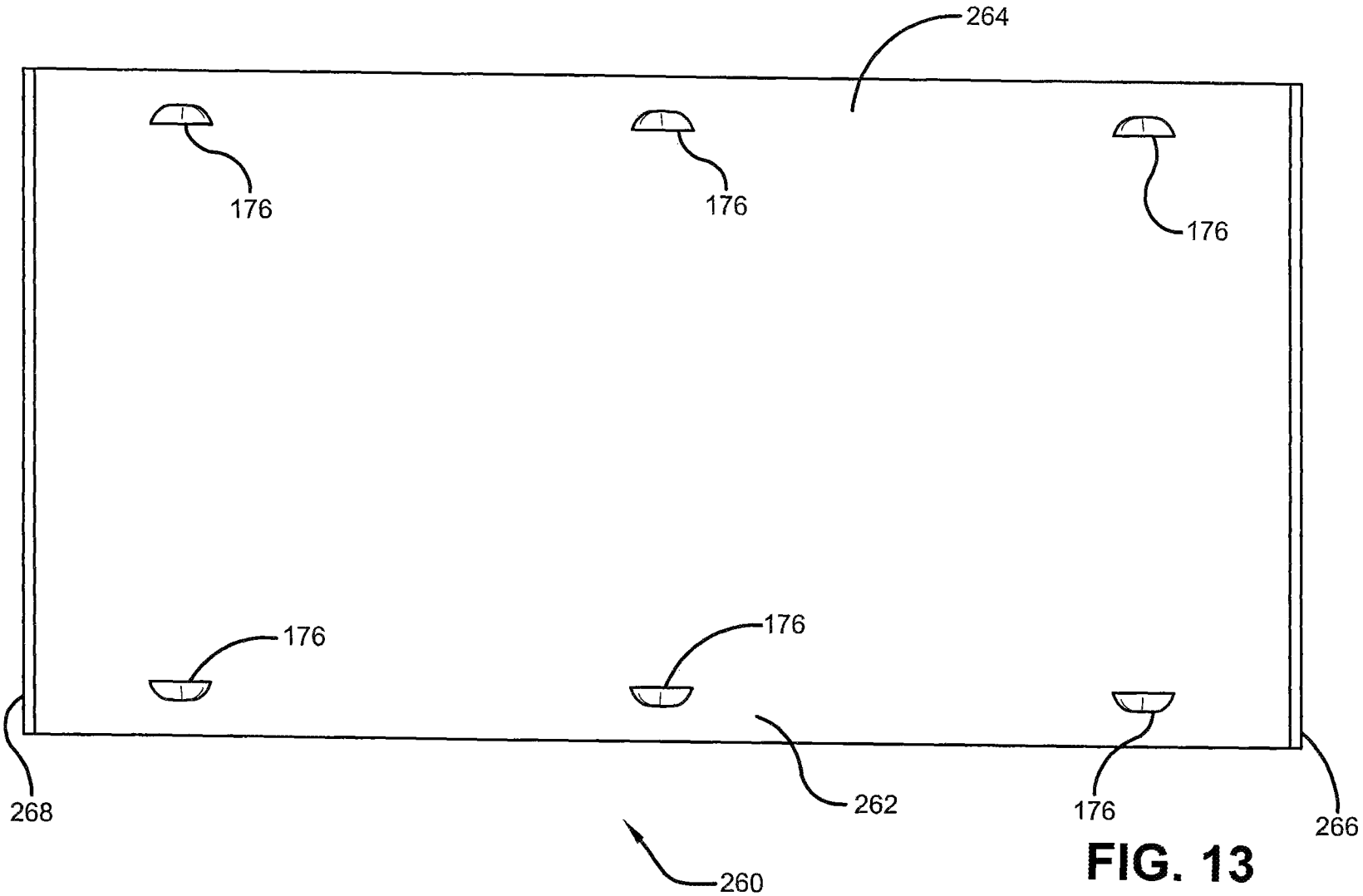
FIG. 13 is a top view of a back wall piece of the exemplary safe body.

The exemplary safe further includes a back wall piece 260 which is shown in FIG. 13. The back wall piece extends on the side of the safe body 141 opposite to the door 272. The exemplary back wall piece 260 includes a lower latching edge portion 262 and an upper latching edge portion 264. Each of the lower and upper latching edge portions include resilient spring tabs of the type previously described. Once the upper latching edge portion 264 is extended in the back top slot when the safe is assembled, the tabs in the upper latching edge portions extend in recesses in the engaging back wall segment 208. Similarly as represented in FIG. 14, the lower latching edge portion 262 extends in back slot 168 and the tabs 176 thereon extend through the recesses in the engaging back wall segment 166.

The exemplary back wall piece 260 includes inturned portions 266 and 268. Inturned portion 268 abuts inturned back portion 240 of side wall piece 222 in the assembled condition as shown in FIG. 14. Similarly inturned portion 266 is in abutting relation with inturned back portion 256 of side wall piece 174. In some exemplary embodiments, the inturned portions 266 and 268 may be connected to the adjacent wall portions by fasteners, clips or similar holding mechanisms which are accessible and installed in the interior area 270 of the safe body. By holding the inturned portions in engaged relation with the adjacent wall portions, the risks for compromising the safe body of the safe is reduced. Of course these approaches are exemplary and in other embodiments, other approaches may be used.

The exemplary embodiment of the safe includes the door 272. The door 272 is sized for closing the access opening 286 to the interior area 270 of the safe, which extends access opening between the front facing portion 232 of side wall piece 222 and front facing portion 272 of side wall piece 174. The access opening is also bounded at the top by front wall segment 212 and at the bottom by front wall segment 150. The door further includes a front face 274 which faces outward when the door is in a closing position, in which the door closes the access opening.

The door includes a top hinge pin 276 and a bottom hinge pin 278. The hinge pins extend along a common axis 280. In the exemplary embodiment, bottom hinge pin 278 is configured to be in operatively engaged relation in bottom hinge pin opening 154. The top hinge pin 276 is configured to be engaged in top hinge pin opening 216. As later discussed, the hinge pins of the exemplary embodiment are configured to be retractable to facilitate installing and removing the door from the body 141 of the safe.

The exemplary door includes user interface 282. The user interface 282 is in operative connection with a lock 284 which is selectively changeable between locked and unlocked conditions. In the closed position of the door and the locked condition of the lock 284, the door blocks the access opening 286 to the interior area 270. The exemplary user interface 282 is shown with the input device 288 and a manually turnable knob 290. In the exemplary embodiment, the user interface 282 shown is configured to enable a user to input a combination or similar sequence of inputs or code through the input device 288, and then to change the condition of the lock 284 from a locked to an unlocked condition by turning the knob to 290. Of course other embodiments may be operative in a manner similar to that later described where inputs through an alternative user interface may be usable to change the condition of the safe lock. For example, in some embodiments the user interface may be suitable for programming combinations as well. This may enable the exemplary safe to be used by different individuals who use the safe to store valuables on a temporary basis, such as in a hotel room or health club. For example circuitry associated with the safe may be usable to program a unique combination that a user may subsequently use to open the safe a single time, after which the combination is cleared from memory by the circuit and a new combination can be set by a subsequent user. Of course this approach is exemplary, and in other embodiments other approaches may be used.

Alternatively or in addition, in some arrangements multiple safes of the exemplary configuration may be configured in adjacent or stacked relation so that different users may personally utilize adjacent safes to store personal belongings therein while excluding others from accessing the contents of the safe. This may be done, for example, in situations where multiple individuals share a common living or working space and each requires their own separate safe for storing their personal valuable possessions. For example, in some dormitory environments or locker room, two or more safes of the exemplary embodiment may be positioned in stacked relation. Of course these approaches are exemplary and in other embodiments, other approaches may be used.

The exemplary user interface 282 utilized on an exemplary embodiment may further include other or additional features for purposes of locking and unlocking the safe. For example, in some exemplary embodiments the user interface may include an output device such as a display screen. The display screen may be suitable for providing the user with instructions for unlocking the door of the safe, programming a new combination or other suitable instructions for operation of the safe.

In other embodiments, the exemplary user interface may include other or different input devices such as, for example, a fingerprint reader. A fingerprint reader may be utilized to identify the fingerprint of a user that is authorized to access the interior area of the safe. In other embodiments, other types of biometric input devices may be utilized for purposes of providing access to the safe. Further it should be understood that some exemplary embodiments may include other features usable to help secure the interior area of a safe from unauthorized access.

Figure 16:
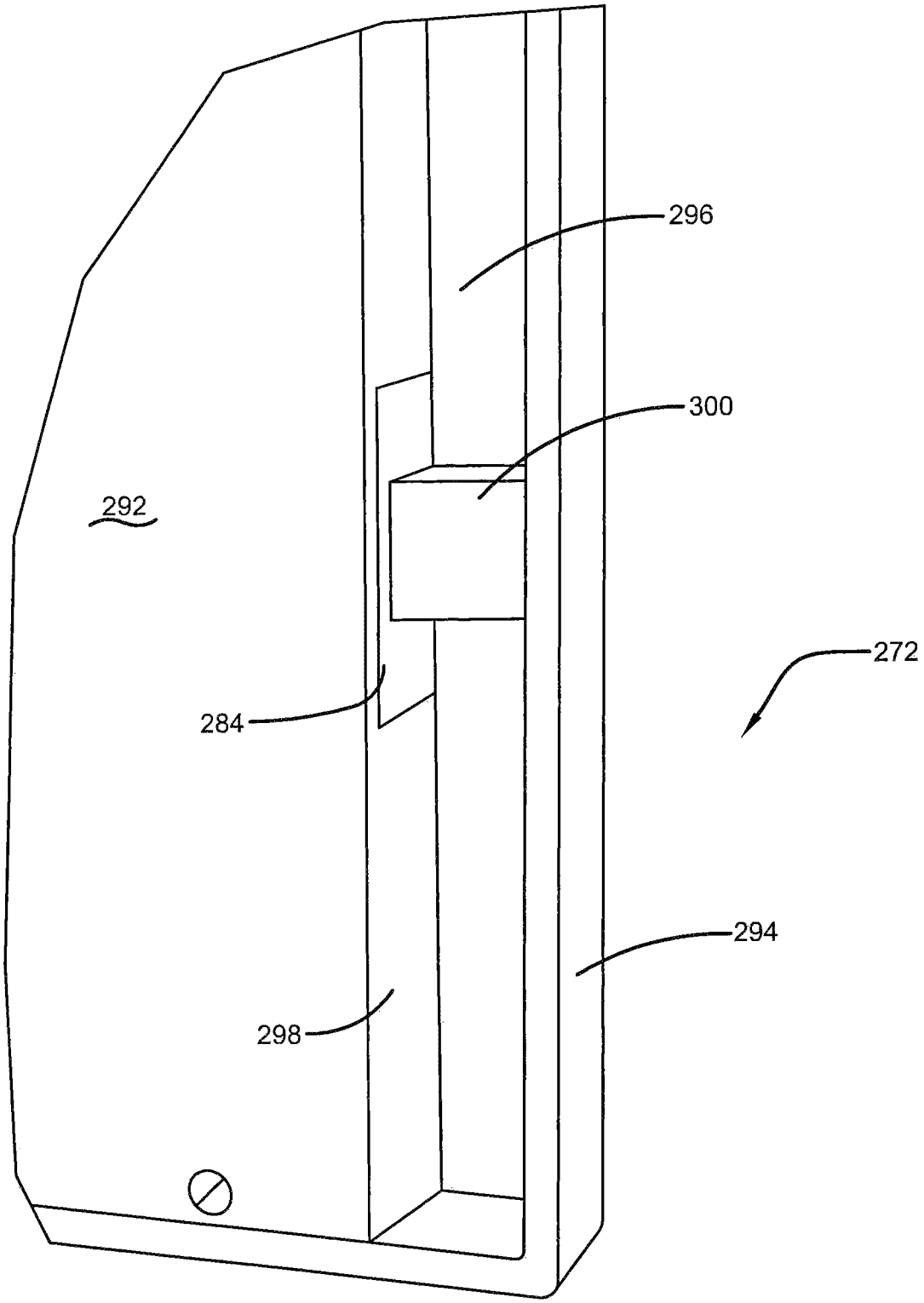
FIG. 16 is a back bottom isometric view of the safe door and a strike recess therein.

FIG. 16 shows a portion of the rear of the door 272. In FIG. 16, the side of the door adjacent the strike is shown. The door 272 includes an inner door face 292. Inner door face 292 includes a removable cover so as to facilitate housing the lock and other components within the door. Door 272 further includes an inturned end portion 294. End portion 294 extends perpendicular to front face 274. A strike recess 296 extends in the door inner face between the inner surface of end portion 294 and the face of lock 284 and a bounding wall 298 adjacent thereto.

The exemplary lock includes a retractable bolt 300. Bolt 300 is configured to engage the strike opening 238 in the strike 236 when the bolt is in an extended position and the door is closed. This corresponds to a locked condition of the lock.

When the lock is unlocked, the bolt 300 is retracted to the left as shown in FIG. 16 into the body of the lock 284. This position also corresponds to the condition of the lock shown from above in the cross-sectional view of the door 272 shown in FIG. 18. With the bolt 300 retracted and disengaged from the strike 236, the door can be swung open from the closed position rotating about the hinge pins and axis 280 to the door open position so as to enable access to the interior area 270 of the safe through the access opening 286. To return the safe to the locked position, the door 272 is closed so as to be in a closed position to block the access opening 286. The condition of the lock is then changed via inputs through the user interface 282 or otherwise and the knob is turned so as to extend the bolt 300 into engaging relation with the strike opening 238. In this locked condition, the door 272 is held in the closed position.

The exemplary configuration of the lock, the strike 236 positioned within the strike recess 296 of the door when the door is closed. In this configuration access to the strike is blocked by the end portion 294, and the ability to compromise the door through the use of saws and other criminal tools is reduced. Of course it should be understood that this configuration is exemplary and in other embodiments, other types of lock, door, strike and latching configurations may be used.

Figure 17:
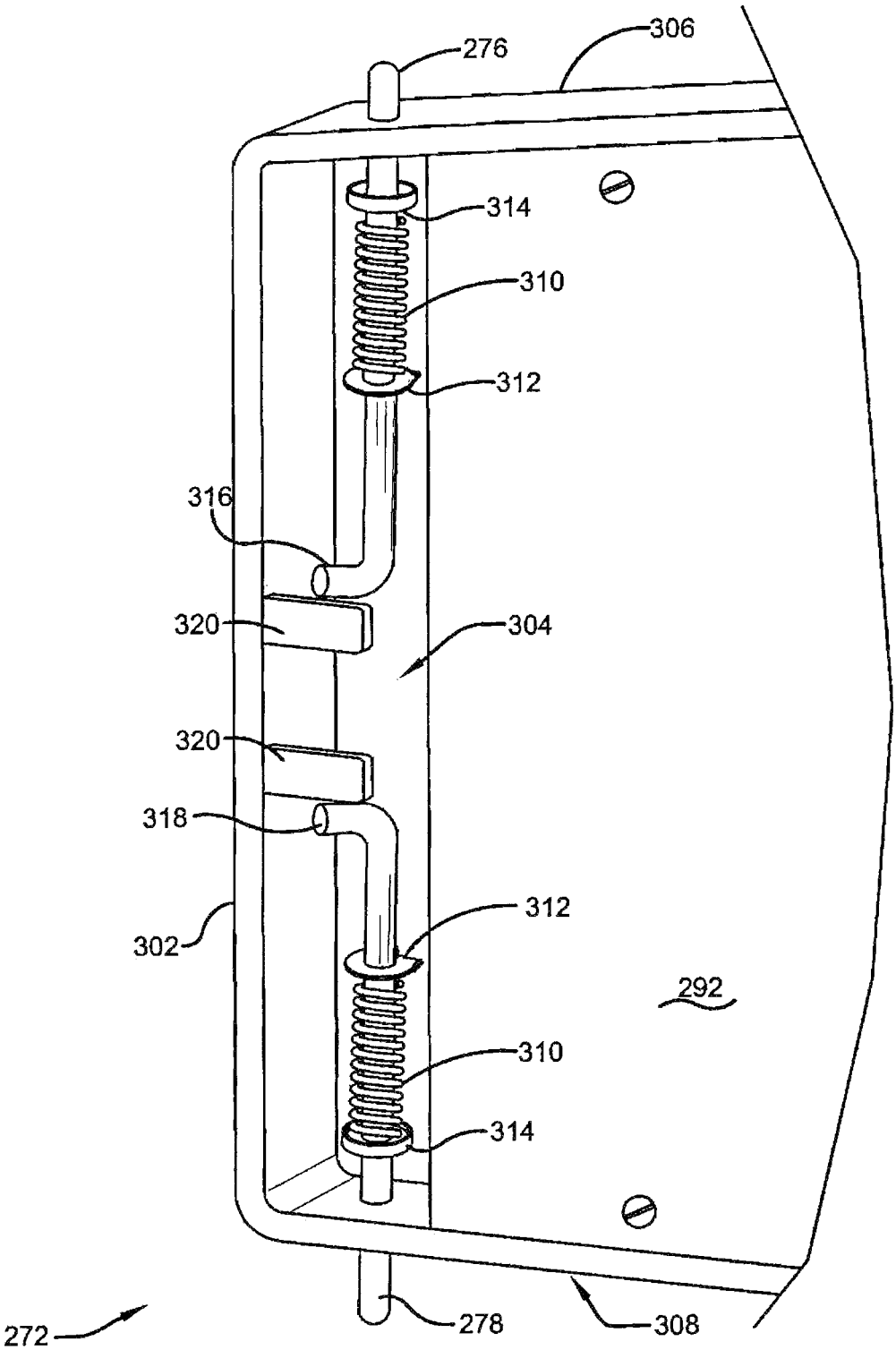
FIG. 17 is a back left isometric view of the safe door and a hinge pin recess therein, and top and bottom hinge pins in the operative position.

FIG. 17 shows the opposed end of the exemplary inner face of the door 272 from that shown in FIG. 16. FIG. 17 shows the hinge side of the door which includes the upper hinge pin 276 and the lower hinge pin 278.

Exemplary door 272 includes an end portion 302 adjacent the hinge side. The end portion 302 extends inward and generally perpendicular to the front face 274. A hinge pin recess 304 extends between the end portion 302 and a wall extending rearward to the inner door face 292.

The door 272 includes an inward extending top portion 306 and an inward extending bottom portion 308. Upper hinge pin 276 is axially movable in an opening that extends in top portion 306. Similarly bottom hinge pin 278 is axially movable in an opening that extends in bottom portion 308. Each of the hinge pins are biased outwardly from the door by respective springs 310. Springs 310 act between inward extending supports 312 and a outward extending land 314 on each hinge pin. In the exemplary arrangement, one side of each land 314 is in biased engagement with a respective spring. In exemplary arrangements, the opposite side of each land 314 can serve as a stop to limit the extent that the respective hinge pin extends outwardly beyond the respective top or bottom portion of the door. Of course this configuration is exemplary and in other arrangements, other approaches may be used.

Exemplary hinge pin 276 includes an inturned portion 316. Similarly exemplary hinge pin 278 includes an inturned portion 318. Each of the hinge pins may be selectively turned within the hinge pin recess so as to be engaged with a respective stop 320. Each stop 320 is configured to engage the inturned portion of a hinge pin and prevent inward movement of the hinge pin such as might occur during efforts to compromise the safe and remove the door. Each respective stop may include detents, recesses, fasteners or other suitable items for holding each hinge pin in engagement therewith.

In the exemplary arrangement, each of the hinge pins 276, 278 may be accessed and manually turned when the safe door 272 is open so as to disengage each hinge pin from its respective stop 320. With the turned portions 316, 318 disengaged from each respective stop 320, each of the hinge pins may be retracted in their respective opening. This enables the door to be disengaged and separated from the respective pin engaging openings 154 and 216 in the bottom wall piece and the top wall piece. This enables removing and separating the door from the safe body. This may be done, for example, to change the door or type of lock that is utilized in connection with the safe.

In addition, in exemplary arrangements the hinge pins 276 and 278 may be manually retracted by engagement therewith after the body of the safe is assembled so as to install the door thereon. Once the hinge pins are positioned in alignment with the respective hinge engaging recesses, each of the hinge pins may then be extended. Once the hinge pins are extended, they may be held in position by turning the respective turned end of each so as to engage the respective stop. This feature may enable more ready installation and changing of the safe door. Of course it should be understood that this configuration is exemplary and in other arrangements, other approaches may be used.

Figure 18:
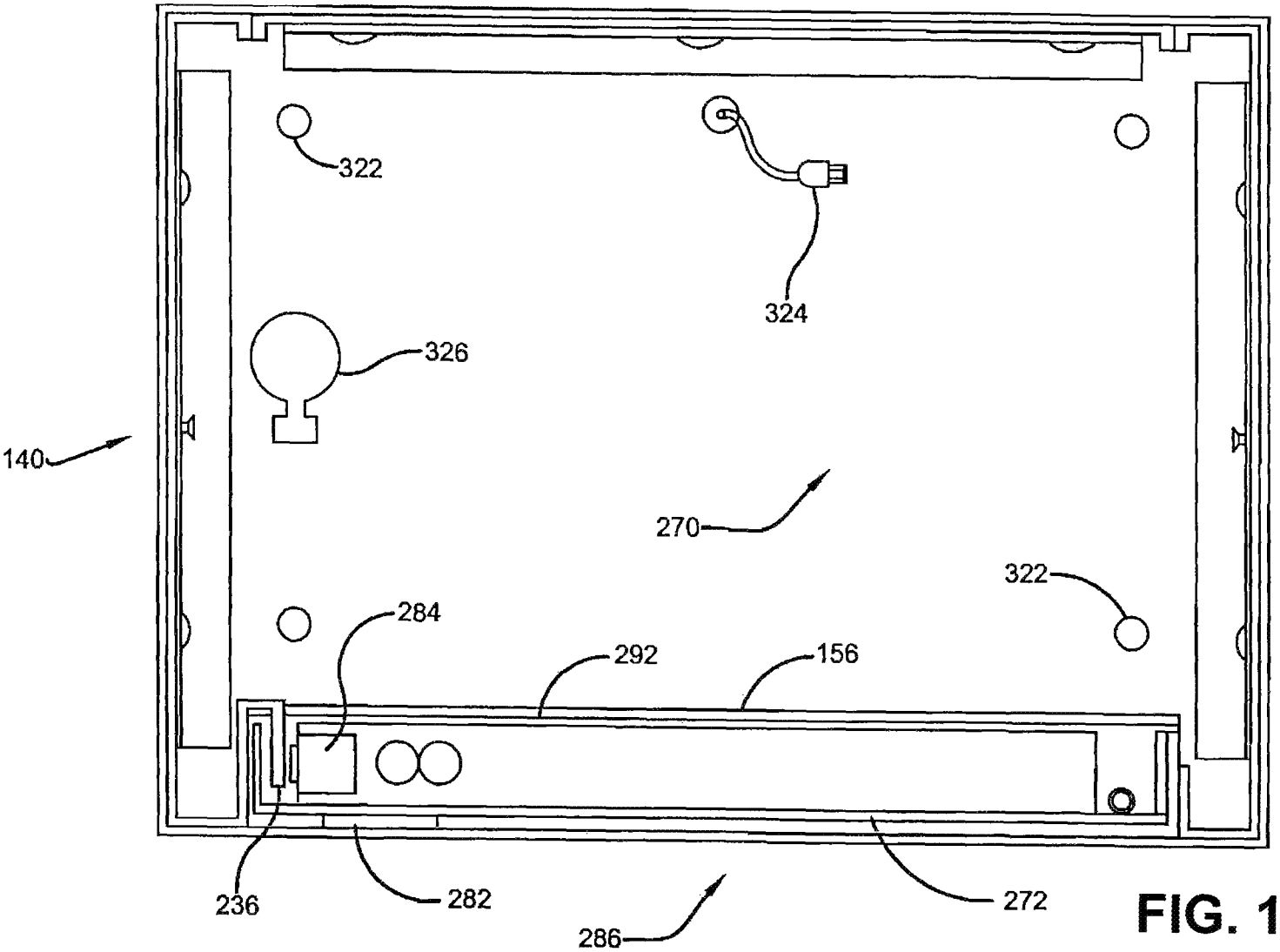
FIG. 18 is a top view similar to FIG. 14, but with the safe door shown in cross-section and installed in operative connection with the safe body.

As can be appreciated in FIG. 18, in the operative position of the safe the bottom turned edge 156 of the bottom shelf 152 and the top turned edge 218 of the top shelf 214 of the exemplary arrangement serve as upward and downward extending stops respectively that prevent movement of the door 272 into the interior area 270 beyond that required to close the access opening 286. Both of the turned edge portions extend substantially the entire width of the access opening. As a result, the bottom portion 308 of the door is engageable at its inner side along a substantial portion of the bottom turned edge 156 when the door is closed. Likewise the inner face of the top portion 306 is engageable with a substantial portion of the top edge 218. This engagement with the surfaces which serve as a stop help to prevent the door 272 from being compromised by being pushed inward when the door is in the closed position. It should be understood that this stop configuration is exemplary and in other embodiments, other approaches may be used. Of course the safe body is enclosed by attachment of the top wall piece to the side and back wall pieces shown in FIG. 18. The top wall piece is attached to the side and back wall pieces in a manner similar to the bottom wallpiece.

FIG. 18 further shows the door 272 in horizontal cross section. Additional components may be housed in the door 272 of the exemplary safe. Such components may include batteries, circuitry, sirens, sensors, transceivers or other suitable devices which are used in connection with operation of the safe. Further as represented in FIG. 18, fasteners 322 may be extended through openings of the bottom wall portion of the safe so as to engage the safe with the top wall of a shelf or other structure positioned below. Access to the fasteners is limited in the exemplary arrangement to persons who can access the interior area 270 of the safe. This further facilitates the security of the exemplary construction. As can be appreciated, similar fasteners may be extended through the upper wall portion so as to engage a structure located above. This may include, for example, an overlying shelf. Alternatively in other arrangements, the attaching fasteners may provide engagement with other structures such as another safe. Of course these approaches are exemplary and in other embodiments, other approaches may be used.

Additional features may be included in the interior area of the exemplary safe. This may include, for example, suitable power connectors for personal items that a user wishes to store within the safe. This may include, for example, a power connector 324 for supplying power to a mobile device such as a smart phone, iPad or similar mobile device. Alternatively, a power connector 326 may be positioned on a wall of the safe. The power connector 326 may include an inductive power connector that enables charging the batteries of the device by placing the device in adjacent relation with the inductive coil of the power connector. Of course these approaches are exemplary and in other embodiments, other approaches may be used.

The exemplary safe construction facilitates the storage and shipment of the safe by providing a compact arrangement in which the wall pieces and door can be shipped flat to the point of assembly. The assembly of the exemplary arrangement can be made without the use of hand tools or simple tools. The exemplary arrangement provides for assembly through manual engagement of the wall pieces and manual installation of the door. Further, once the wall pieces have been assembled, there is difficulty in compromising the integrity of the safe container body and the door. Of course alternative embodiments may use only portions of these features and may still benefit from one or more of the inventive principles described.

Figure 19:
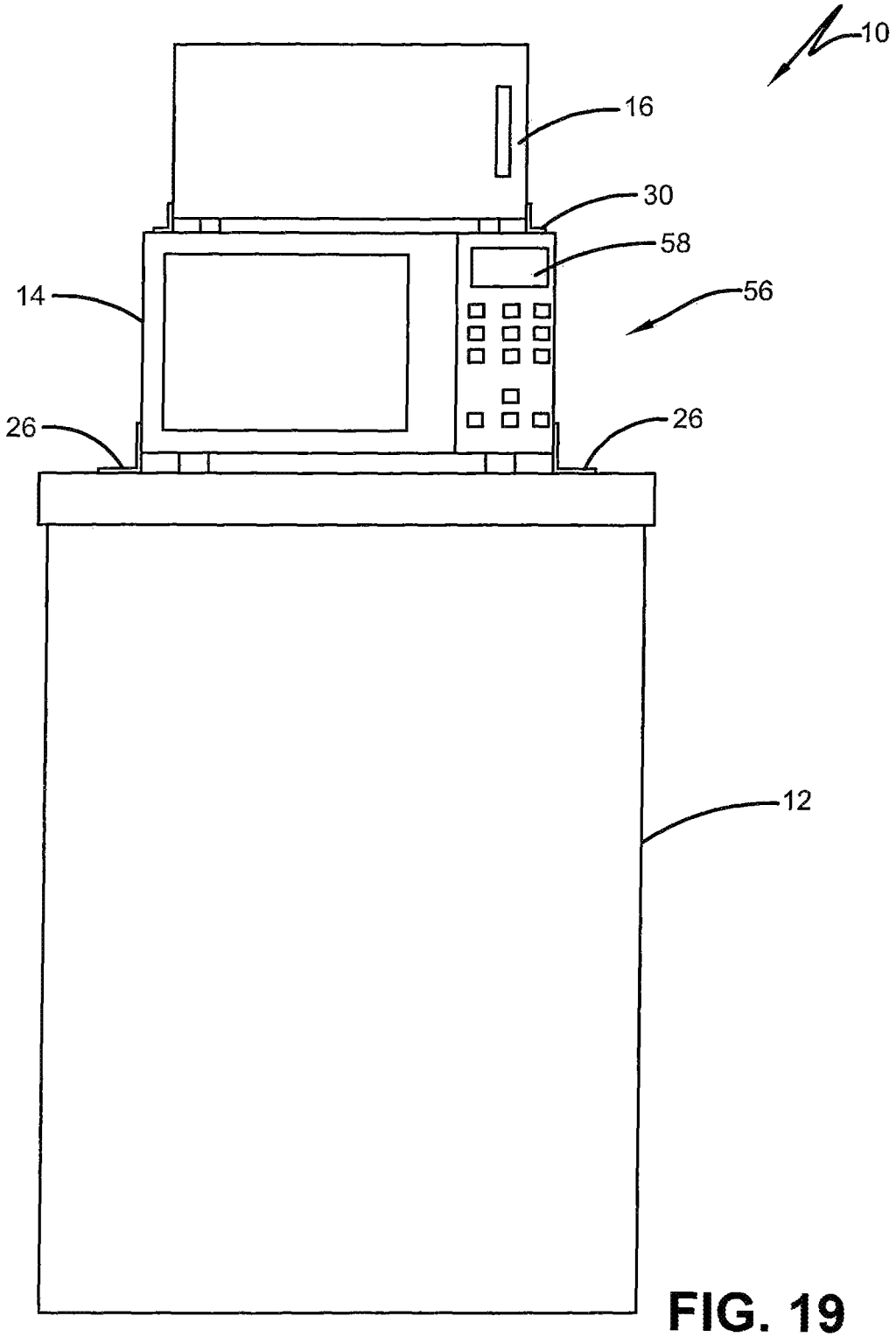
FIG. 19 is a front view of an exemplary appliance unit that includes a safe as well as a microwave oven and a compact refrigerator.

Exemplary embodiments of a safe of the type described may be integrated in an appliance 10 such as is shown in FIG. 19. Appliance 10 is an integrated operational appliance unit that performs the functions of a compact refrigerator, a microwave oven and a safe. Such an integrated appliance unit may be useful for example in hotels, dormitories or other facilities where the functions of refrigerated storage, cooking small items and securely storing valuables are required.

Figure 22:
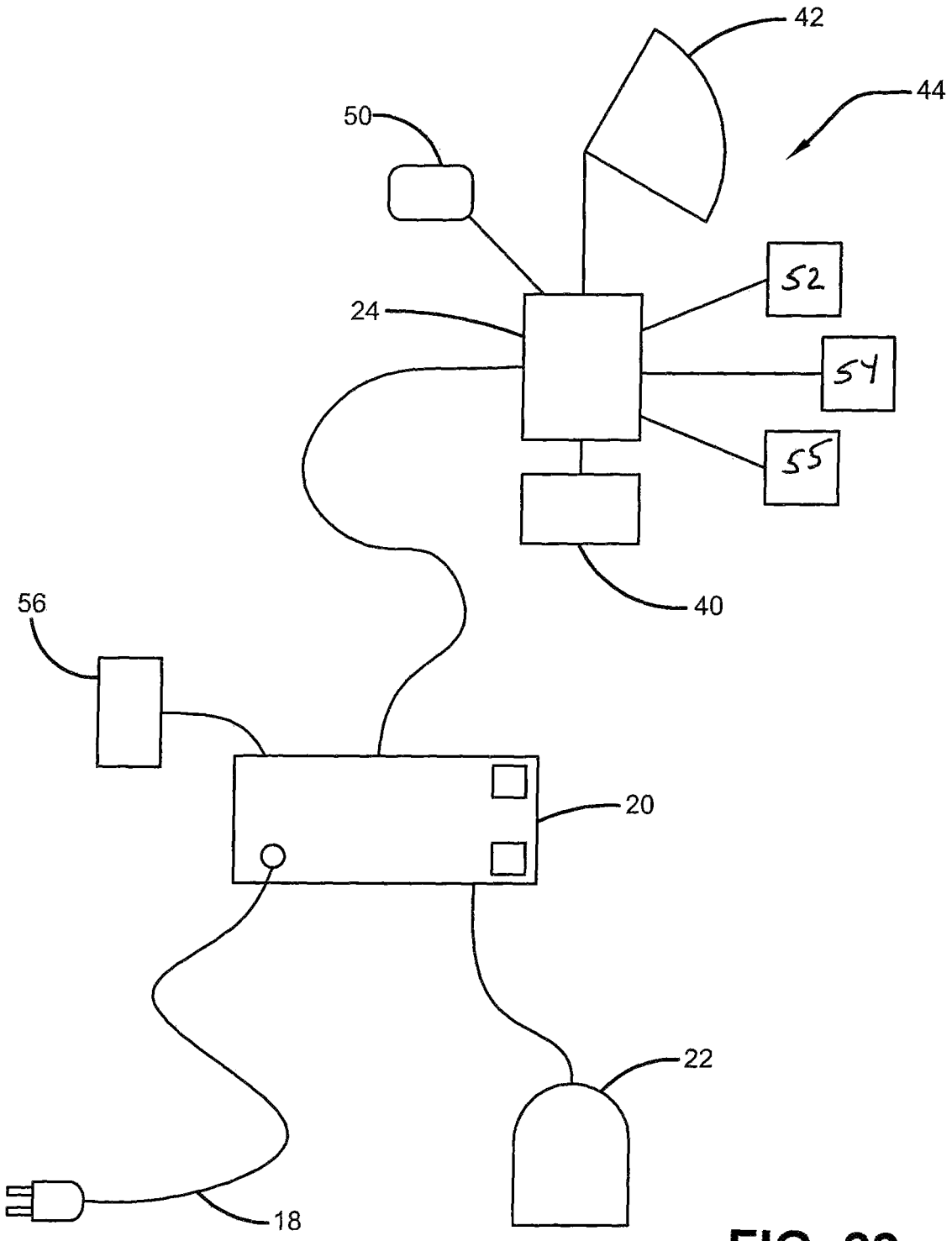
FIG. 22 is a schematic view of electrical components associated with the exemplary appliance unit including a safe.

Appliance 10 includes a compact refrigerator portion 12. The refrigerator 12 is operative to support a microwave oven portion 14. The microwave oven 14 is supported in stacked relation on an upper surface of the refrigerator body. In this exemplary arrangement, a safe 16 is supported by an upper surface of the microwave oven. The exemplary appliance 10 is operative to utilize a single releasable connection to a source of household current as represented by power cord 18 in FIG. 20. The power cord of the exemplary arrangement is in operative connection with power control circuitry 20 as schematically represented in FIG. 22. The power control circuitry of the exemplary arrangement is operative to deliver power to the microwave and the refrigerator compressor 22 and other electrical components associated with the refrigerator 12. The exemplary power control circuitry 20 is also operative to deliver power to at least one safe circuit 24 that is included in the safe 16.

In the exemplary arrangement, the power control circuitry is operative to monitor the power draw or other conditions of the devices which draw the power during operation of the combined appliance. The exemplary power control circuitry is operative to avoid the combined power draw of the devices which make up the appliance from exceeding a set limit. For example in situations where the user wishes to operate the microwave while the refrigerator compressor is running and such condition would cause an excessive load, the power control circuitry is operative to withhold power to the compressor while the microwave operates. Such exemplary approaches enable the energy efficient operation of the appliance and serves to avoid an excessive power draw that may exceed the limits of a circuit breaker or associated wiring. Alternatively embodiments may be operative to withhold power to one or more other components of the unit when another component of the unit is operated. The exemplary embodiments may include features like those described in U.S. Pat. No. 8,742,304 granted Jun. 3, 2014, the disclosure of which is incorporated herein by reference in its entirety.

Alternatively or in addition, exemplary embodiments of the power control circuitry may be operative to detect the connected status of one or more components of the microwave, refrigerator and/or safe to the power control circuitry. Such exemplary power control circuitry may be operative responsive to sensing that there is a loss of electrical connection to make a determination as to whether the condition is a result of vandalism or attempted theft of components of the appliance. In response to detecting an electrical disconnection, the exemplary power control circuitry may be operative to provide one or more wired or wireless signals so as to provide an indication to a monitoring station or individuals in the area of the appliance of the abnormal condition. In addition, the appliance may include an audible enunciator that is operative to provide audible alarm signals. Further in other exemplary arrangements, the exemplary power control circuitry may be operative to avoid the damaging effects of power fluctuations, power surges, power bursts caused by lightning strikes, and to provide other functions. Of course these functions are exemplary and in other arrangements, the power control circuitry may perform different or additional functions.

In the exemplary arrangement, the appliance includes brackets to reduce the risk of theft of the appliance and its components. In the exemplary arrangement shown in FIG. 20, brackets 26 extend on each side of the body of the microwave 14. Exemplary brackets 26 are connected via secure fasteners to the body of the refrigerator and the body of the microwave so as to resist the separation thereof. In the exemplary embodiment the fasteners used for connecting the brackets include screw heads that are configured to prevent the loosening or disconnection thereof using normal tools. Of course it should be understood that this bracket arrangement is exemplary and in other arrangements, other approaches may be used.

The exemplary arrangement further includes at least one bracket 28. The exemplary bracket 28 extends on the rear of the appliance. The bracket 28 directly operatively connects the refrigerator body and the safe body. Bracket 28 spans the intermediate component body of the microwave oven 14. Further in some exemplary arrangements, bracket 28 may include connections to the body of the microwave oven as well. Further it should be understood that while in the exemplary arrangement shown in FIGS. 19 and 20, the components of the appliance unit are stacked so that the microwave oven 14 is positioned intermediate of the refrigerator 12 and the safe 16, in other arrangements such as that hereinafter described, the safe may be positioned intermediate of the refrigerator and the microwave oven. In such arrangements, brackets such as bracket 28 may be usable to span the intermediate device so as to assure the connection of the refrigerator to the uppermost component of the appliance unit. In other embodiments other components such as the safe may be the bottom component. Other components such as the refrigerator, the microwave oven (and other components) may be positioned as the top component and at least one intermediate component. In some arrangements multiple safes may be included in the appliance unit.

Figure 24:
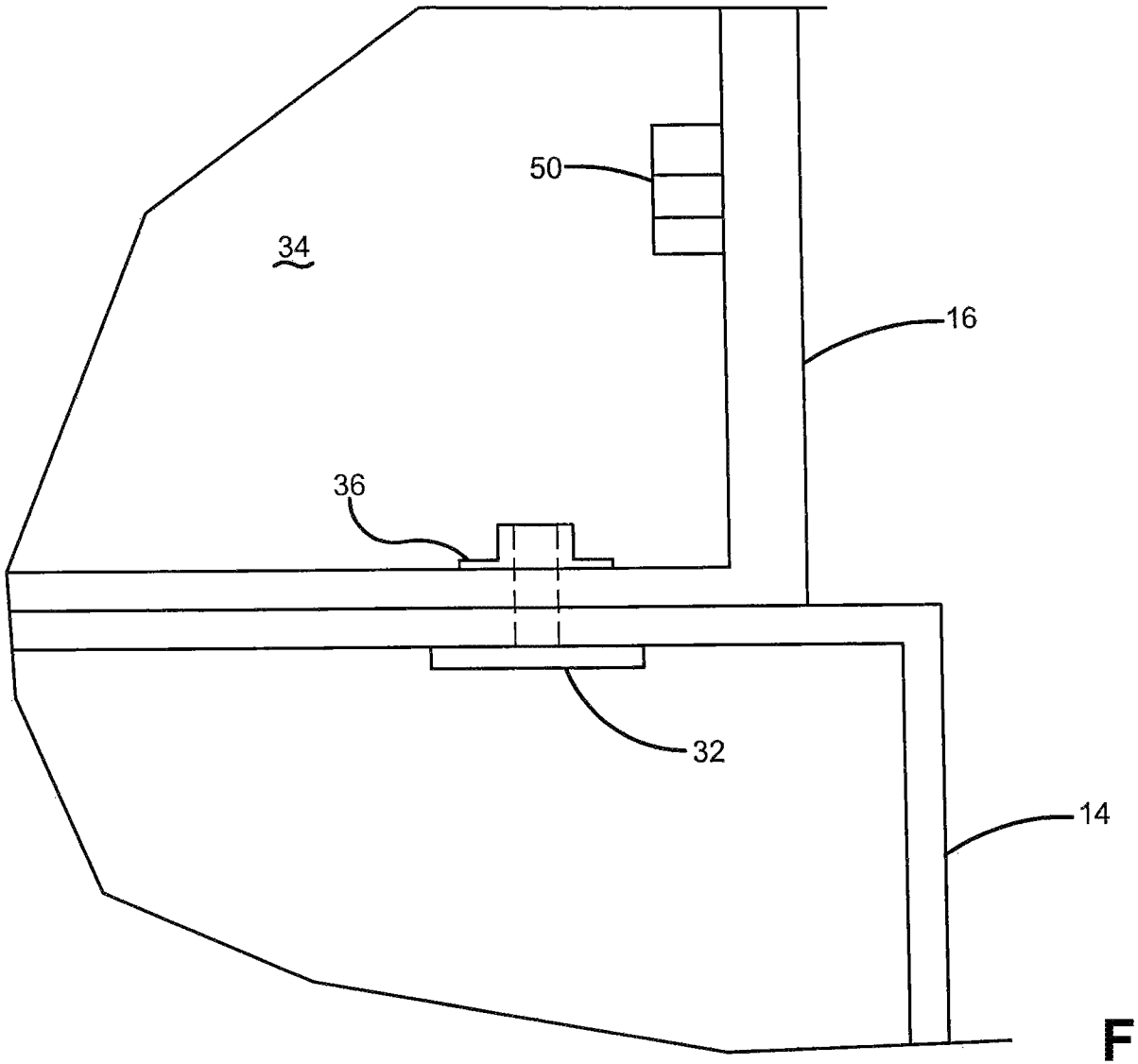
FIG. 24 is a partial front view showing a mounting arrangement for a safe.

Further in exemplary arrangements, additional brackets may be used to secure the components together. For example as shown in FIG. 19, external brackets 30 are utilized to hold the body of the microwave and the body of the safe in engagement. In exemplary arrangements the brackets 30 may be similar to brackets 26 and be held to each of the microwave and the safe through fasteners that are configured to prevent disengagement. Alternatively or in addition, in some exemplary arrangements internal fasteners may be used. For example FIG. 24 shows an exemplary mounting arrangement for attaching the safe 16 in engagement with an underlying portion of the appliance such as the body of microwave oven 14. In the exemplary arrangement the bodies are attached through a threaded stud 32 that extends through the bodies of the microwave oven and the safe in an area that is not externally accessible. As represented in FIG. 24, the upper threaded portion of the stud 32 extends in an interior area 34 of the safe 16. A releasable fastener 36 which in this exemplary arrangement comprises a threaded nut is engaged with the threaded portion of the stud within the interior area. The releasable fastener 36 is only accessible within the interior area 34 of the safe such that the threadable fastener can only be disconnected when the safe is open. Such an arrangement reduces the risk of persons who do not have access to the safe attempting to disengage the safe from the rest of the appliance unit structure so as to abscond with the safe. Of course as can be appreciated multiple such studs and releasable fasteners may be utilized in exemplary arrangements to hold the safe in engagement with the rest of the appliance.

Figure 20:
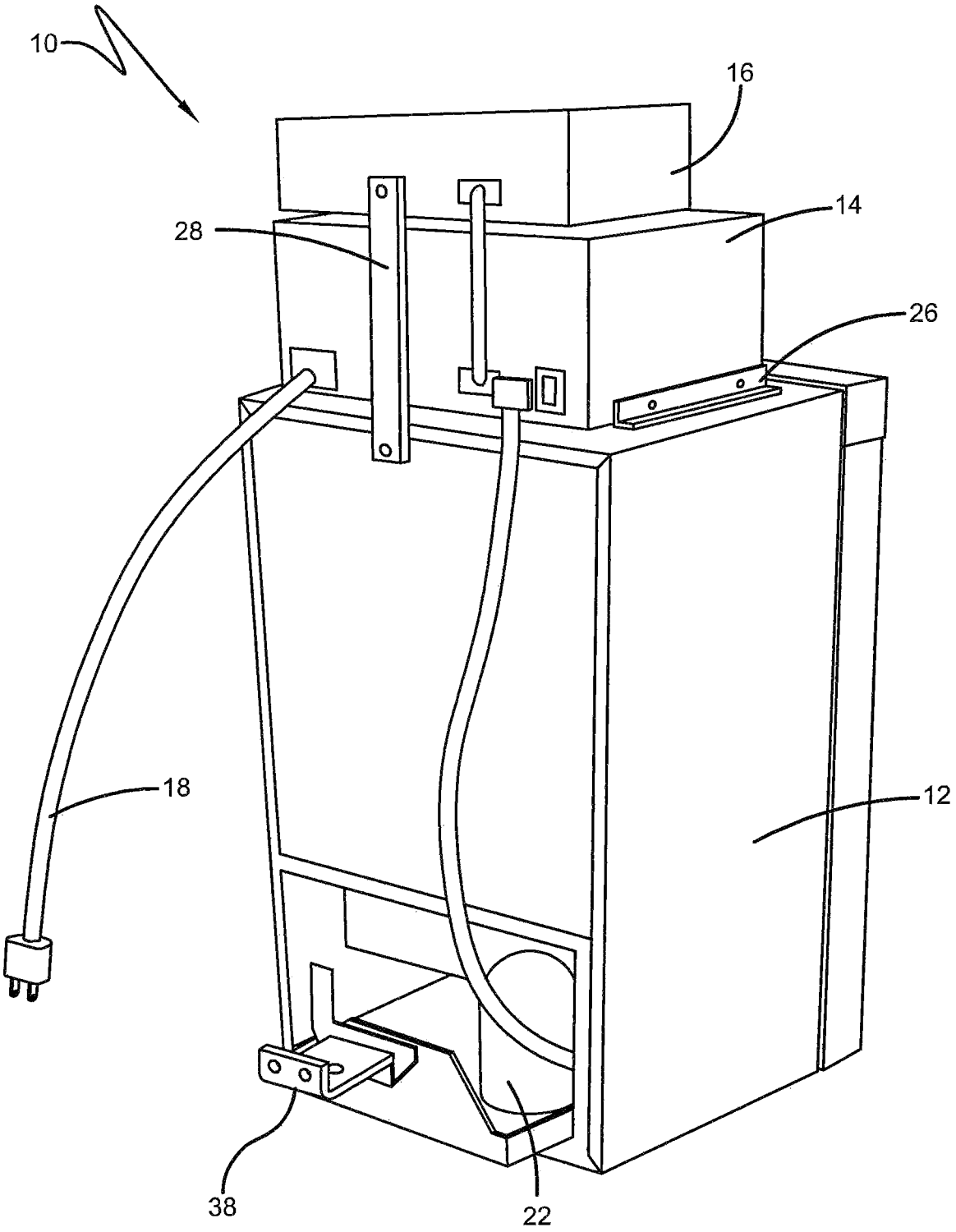
FIG. 20 is isometric rearview of the appliance unit including the safe as shown in FIG. 19.

As represented in FIG. 20 the exemplary refrigerator 12 includes one or more anti-theft brackets 38. The exemplary anti-theft bracket 38 is a generally L-shaped bracket that is in fixed connection with the body of the refrigerator 12. The L-shaped bracket includes a plurality of apertures which are configured for accepting fasteners therethrough. The configuration of the exemplary anti-theft bracket enables fasteners to be connected through the apertures to adjacent surfaces such as a wall behind the appliance or the supporting floor structure or both. Fastening the refrigerator to an adjacent surface of a structure such as a wall or floor further reduces the risk that the appliance can be removed from its operative position for purposes of theft or vandalizing the appliance.

Further used to reduce the risk of theft or vandalism of the exemplary appliance 10 is the at least one safe circuit 24 as represented in FIG. 22. The at least one safe circuit is in operative connection with a battery 40. The exemplary safe circuit 24 is further in connection with a loud, audible enunciator 42. The audible enunciator 42 may in some embodiments include a piezoelectric alarm device which provides a loud audible signal to indicate tampering or an effort to gain access to the interior area of the safe.

The exemplary safe circuitry is further in operative connection with a plurality of sensors 44. In the exemplary arrangement safe sensors 44 are operative to sense one or more tamper conditions associated with the safe. In the exemplary arrangement the safe circuit is operative responsive to one or more of the sensors sensing a safe tamper condition to cause the audible enunciator 42 to provide a loud alarm signal to indicate tampering. Further because the safe circuitry can be operated by the battery 40, the enunciator of the exemplary arrangement will continue to provide an alarm even if the safe is separated from the power control circuitry 20. Further in exemplary embodiments the safe circuitry may be operative to cause the transmission of wire or wireless signals indicative of an alarm condition.

Figure 21:
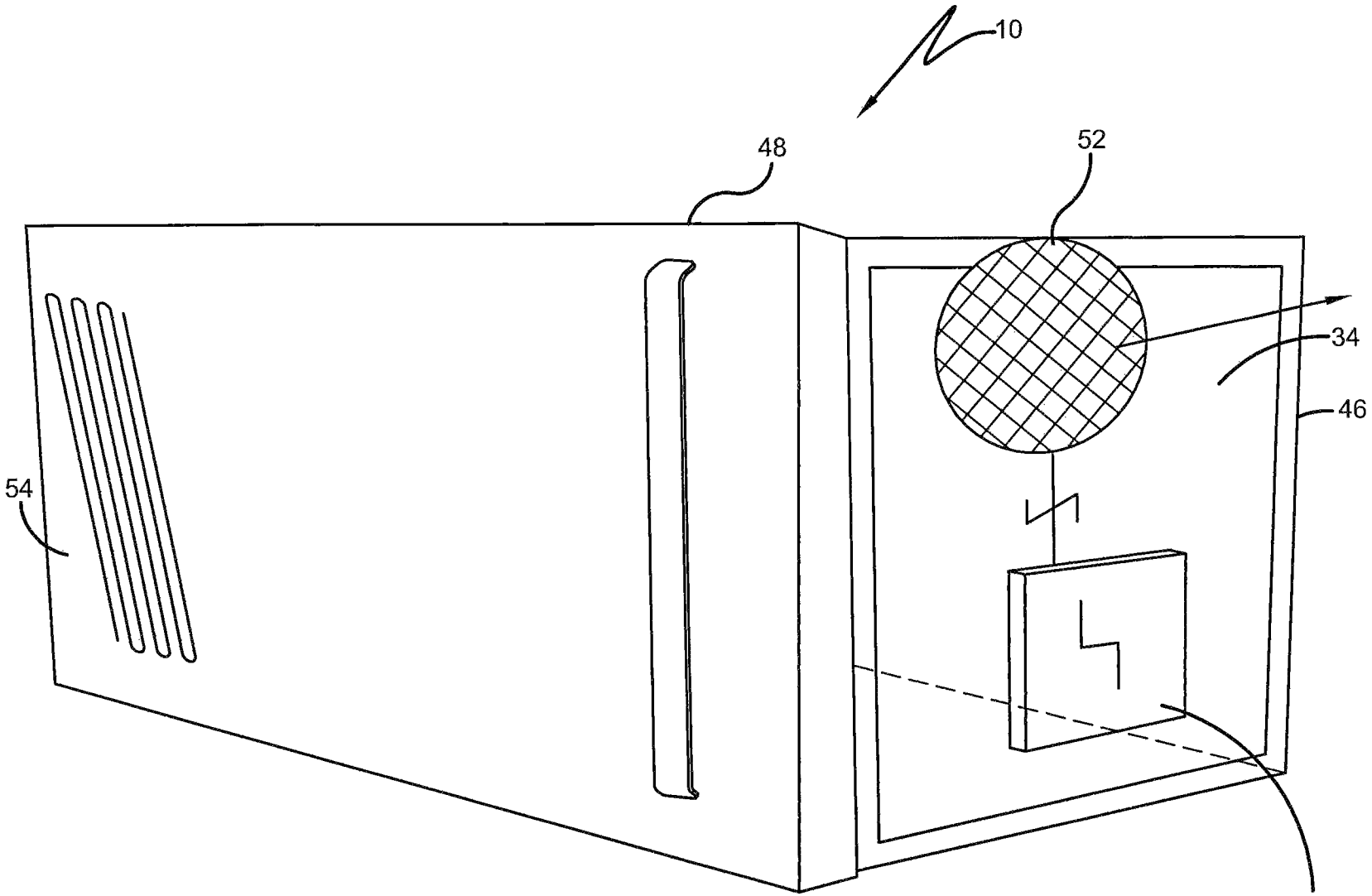
FIG. 21 is a schematic view of exemplary circuitry associated with a safe of an exemplary embodiment.

As represented in FIG. 21, the exemplary safe similar to safe 137 previously discussed includes a safe body 46 which bounds the interior area 34 of the safe. The interior area includes a safe opening at a forward side thereof. A safe door 48 is movably mounted in supported connection with the safe body 46. The safe door is movable between an open position in which the interior area of the safe is accessible from outside the safe and a closed position in which the interior of the safe is inaccessible.

The safe further includes a lock 50 which is selectively operative to hold the safe door in the closed position. The exemplary lock 50 is an electrically actuated lock that is in operative connection with the at least one safe circuit 24 and is selectively changeable between locked and unlocked conditions.

The exemplary sensors which sense tamper conditions of the safe include in the exemplary embodiment a material mesh schematically indicated 52 in FIG. 21. The material mesh 52 in the exemplary arrangement includes an electrically conductive material that extends adjacent to at least a portion of the interior area 34. In the exemplary arrangement the at least one safe circuit is operative to sense the change in integrity of the material mesh 52 which may indicate that the body of the safe is being drilled or otherwise being compromised. Such a compromise may cause a change in inductance, capacitance, conductance, impedance or other properties of the material mesh which is detectable by the safe circuitry. The safe circuitry then operates to cause the audible enunciator to provide an output audible alarm.

Another safe sensor of an exemplary embodiment includes a conductive trace 54. The conductive trace which is shown schematically in FIG. 21 is an electrically conductive path which may extend inside or within the walls or the door bounding the interior area. The conductive trace is in operative connection with the safe circuitry. A break in continuity of the conductive trace may be indicative of cutting, drilling or other activity which corresponds to an effort to compromise the safe. In the exemplary arrangement the safe circuitry is operative to detect a break in electrical continuity of the conductive trace and to cause the alarm enunciator to give an output audible alarm in response thereto. Further it should be understood that one or more conductive traces may also be positioned on or in connection with mounting brackets, fasteners or other items which are utilized to hold the safe in connection with the microwave or other structures. Such conductive traces may also be monitored through operation of the safe circuitry to detect detachment or other conditions which may correspond to an attempt to compromise the safe and to give one or more alarm signals in response thereto.

Further in other exemplary arrangements the sensors in operative connection with the safe circuitry may include a position sensor 55. A position sensor may include, for example, a contact sensor or switch that is positioned to detect relative displacement which represents relative movement of the safe. Such relative displacement may be detected with respect to the underlying unit structure such as the microwave or refrigerator. Alternatively or in addition, such relative displacement may be relative movement with respect to other fixed points within the environment in which the safe is mounted. In exemplary arrangements, relative displacement of the safe body is operative to cause a change in condition of the position sensor 55. The change in condition of the sensor is detected through operation of the safe circuitry which causes the alarm enunciator to give an alarm in response thereto. In other arrangements the position sensor may be operative to sense movement of the safe door relative to the safe body when the lock is in the locked condition. This may be indicative of an attack on the safe door. Alarms can be given remotely to monitoring stations in addition or as an alternative to the audible alarm. Of course it should be understood that these approaches and sensing devices are exemplary and in other embodiments other approaches may be used.

In the exemplary arrangement of appliance 10, the microwave oven portion includes at least one user input device 56. In the exemplary arrangement the at least one user input device 56 may include manually actuatable buttons, knobs, switches, wireless portals or other suitable input devices through which user inputs may be received. Such user input devices of the exemplary arrangement are operative to control the microwave oven 16 for purposes of cooking and heating items that are held therein. Further in the exemplary arrangement, the at least one user input devices 56 is operable to provide inputs for purposes of controlling the locked and unlocked condition of the safe 16. In an exemplary arrangement a user is enabled to provide one or more inputs to indicate that they wish to change the safe from the locked condition to an unlocked condition. Responsive to such an input, the associated circuitry, which in the exemplary embodiment is included in the power control circuitry 20, is operative to prompt the user through an output device such as a display 58, to provide inputs through the input devices 56 which correspond to a combination or other appropriate inputs that the circuitry recognizes as appropriate to change the condition of the lock. Responsive to the receipt of such inputs through the at least one input device 56, the circuitry 20 is operative to communicate with the safe circuitry 24 so as to change the condition of lock 50 from the locked condition to the unlocked condition, for example. In response to receipt of these signals, the lock 50 is operative to change to the unlocked condition and enable the door 48 to be opened. In this condition a user is enabled to access the contents of the interior area 34 of the safe.

In some exemplary embodiments the power control circuitry 20 and/or safe circuitry 24 is operative to enable a user to provide inputs so as to change the combination that will open the safe when the safe is in the unlocked condition. Such approaches may be useful when the appliance 10 is used in an environment such as a hotel where each guest may wish to utilize the safe with a different combination. The exemplary circuitry is operative to provide a user with outputs such as through the display 58 or other output device, so as to prompt a user to provide particular inputs through the at least one input device 56 if they wish to change the combination for the safe. Responsive to receiving such an input, the exemplary circuitry is operative to further prompt the user through the display to input certain digits or other values that will make up the new combination for opening the safe. The user is then enabled to input such values through the at least one input device 56 of the microwave oven so as to program the circuitry to enable unlocking the safe in response to the input of such combination in the future. Thereafter the user may store items within the interior area of the safe, and close the door thereof which is operative to change the lock 50 to the locked condition. The user can thereafter access the safe by providing appropriate inputs through the at least one input device. Of course this approach is exemplary and in other embodiments, other approaches may be used.

Further exemplary circuitry used in connection with certain embodiments may enable authorized persons such as the proprietors of the hotel or other facility in which the appliance is located to unlock the safe in the event that the user forgets the combination or leaves the hotel with the safe in a locked condition. For example, exemplary circuitry may include programming to open the safe in response to a combination that is known only by the proprietor of the establishment in which the appliance is installed. Of course these approaches are exemplary and in other embodiments other approaches may be used.

Figure 23:
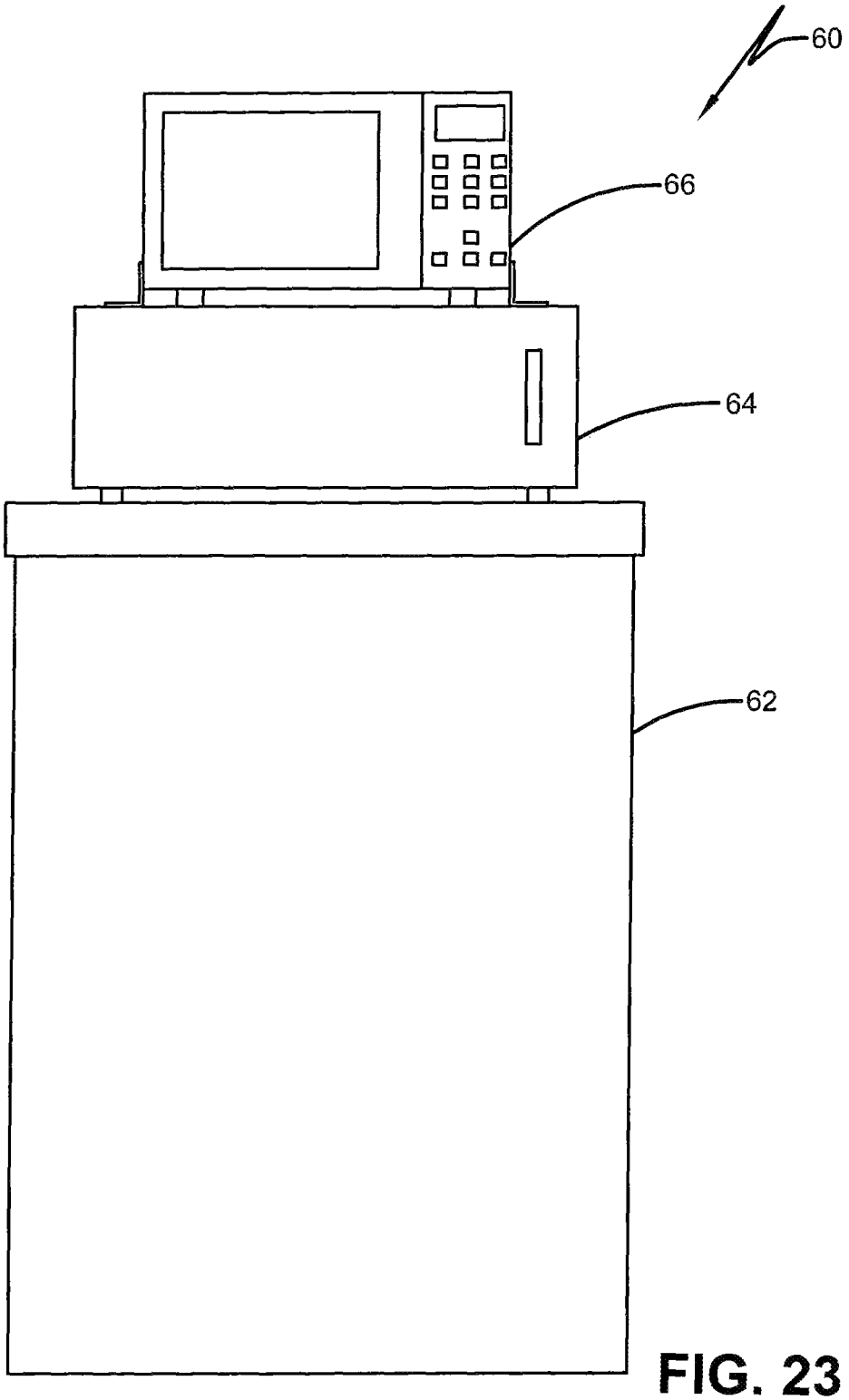
FIG. 23 is an alternative arrangement of an appliance unit that includes an exemplary safe.

FIG. 23 shows an alternative exemplary arrangement of an appliance 60. Appliance 60 may include features similar to appliance 10 previously described. Appliance 60 is a unit which has the stacked configurations of the microwave oven and the safe reversed relative to appliance 10. Specifically in appliance 60 a refrigerator 62 directly supports a safe 64. The safe 64 directly supports the microwave oven 66. In this exemplary appliance 60, the microwave oven is positioned at a higher elevation so as to facilitate the use thereof relative to appliance 10. Further it should be understood that other exemplary arrangements may include different configurations. For example in some exemplary configurations, the safe may be positioned below the refrigerator portion so as to provide support thereto. Such an approach may be appropriate in some arrangements in which the safe portion may be constructed of very heavy materials which are not ideally supported by the relatively lighter weight body of the refrigerator. Further in such arrangements anti-theft brackets to adjacent surfaces such as floors and walls may be attached at the lowest level directly to the safe. Alternatively or in addition, anchor straps, cables or other suitable anchors may also be attached between the safe body and adjacent structures so as to reduce the risk of the safe being moved.

Alternatively or in addition, additional device functionality may be added to the exemplary combined appliance unit. For example in some exemplary arrangements a large display screen such as for displaying television programs may be incorporated into a forward facing surface of the refrigerator, safe or microwave oven component. Such a display surface may be utilized for displaying video or other television programming as may be selected by a user. In some such arrangements the user input devices associated with controlling the microwave and/or the safe may also be utilized in connection with controlling the display output of video signals. Of course as can be appreciated, a remote device may also be used for controlling such a display. The inclusion of circuitry suitable for displaying video and/or television programming in connection with an appliance may further be useful for purposes of conserving space in small spaces such as hotel rooms and dormitory rooms. Other exemplary arrangements may integrate other functional components, such as a coffee maker or a food processor. Further the exemplary power control circuitry may be useful in terms of minimizing power draw and avoiding excessive load conditions when multiple functions of the appliance are attempted to be operated at the same time and may also operate to protect the circuitry associated with the appliance from potentially damaging conditions. Of course these approaches are exemplary and in other arrangements other approaches may be used.

Figure 25:
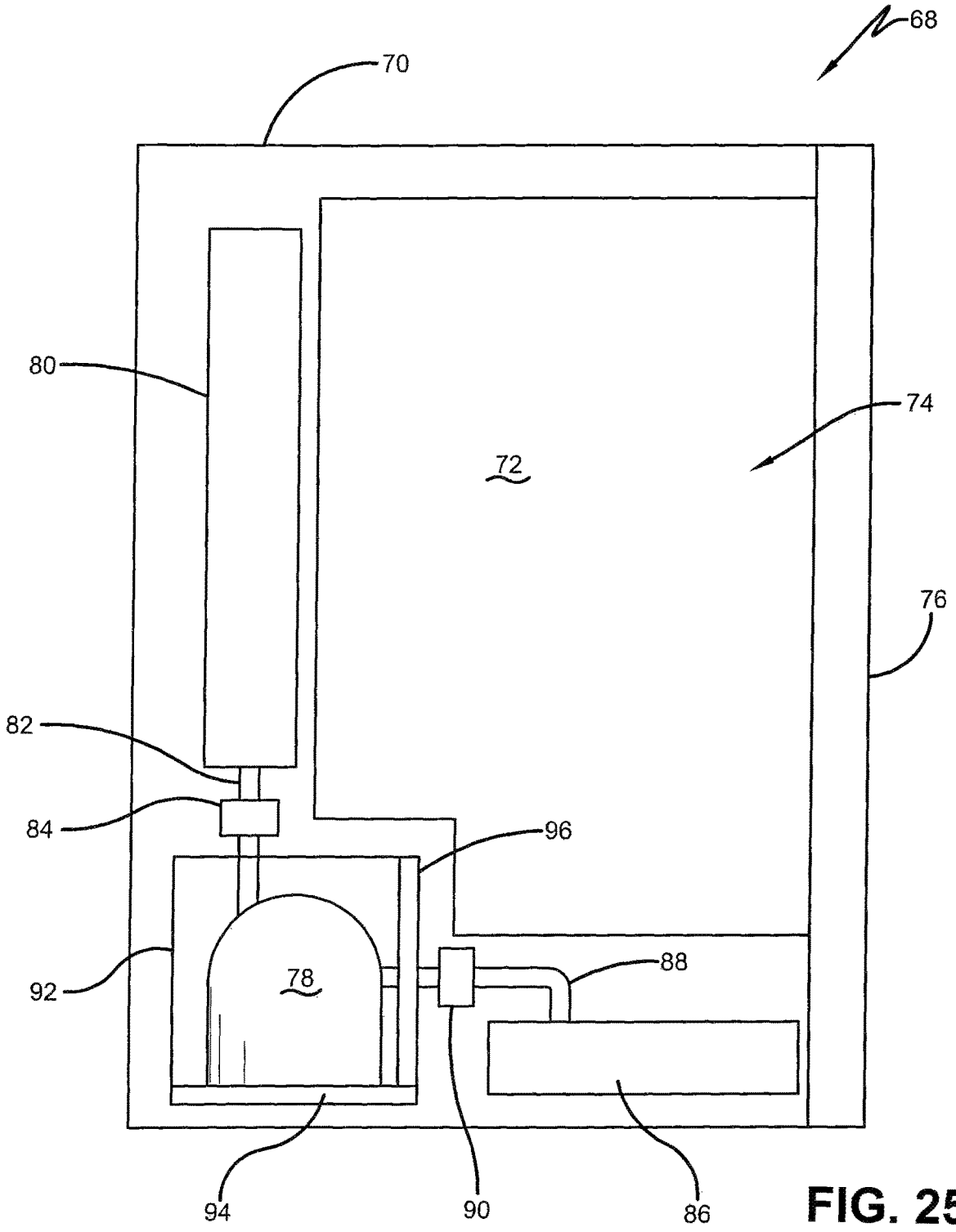
FIG. 25 is a schematic transparent view of a portion of the appliance unit including the safe, including a compact refrigerator with a removable vibration isolating encasement.
Figure 26:
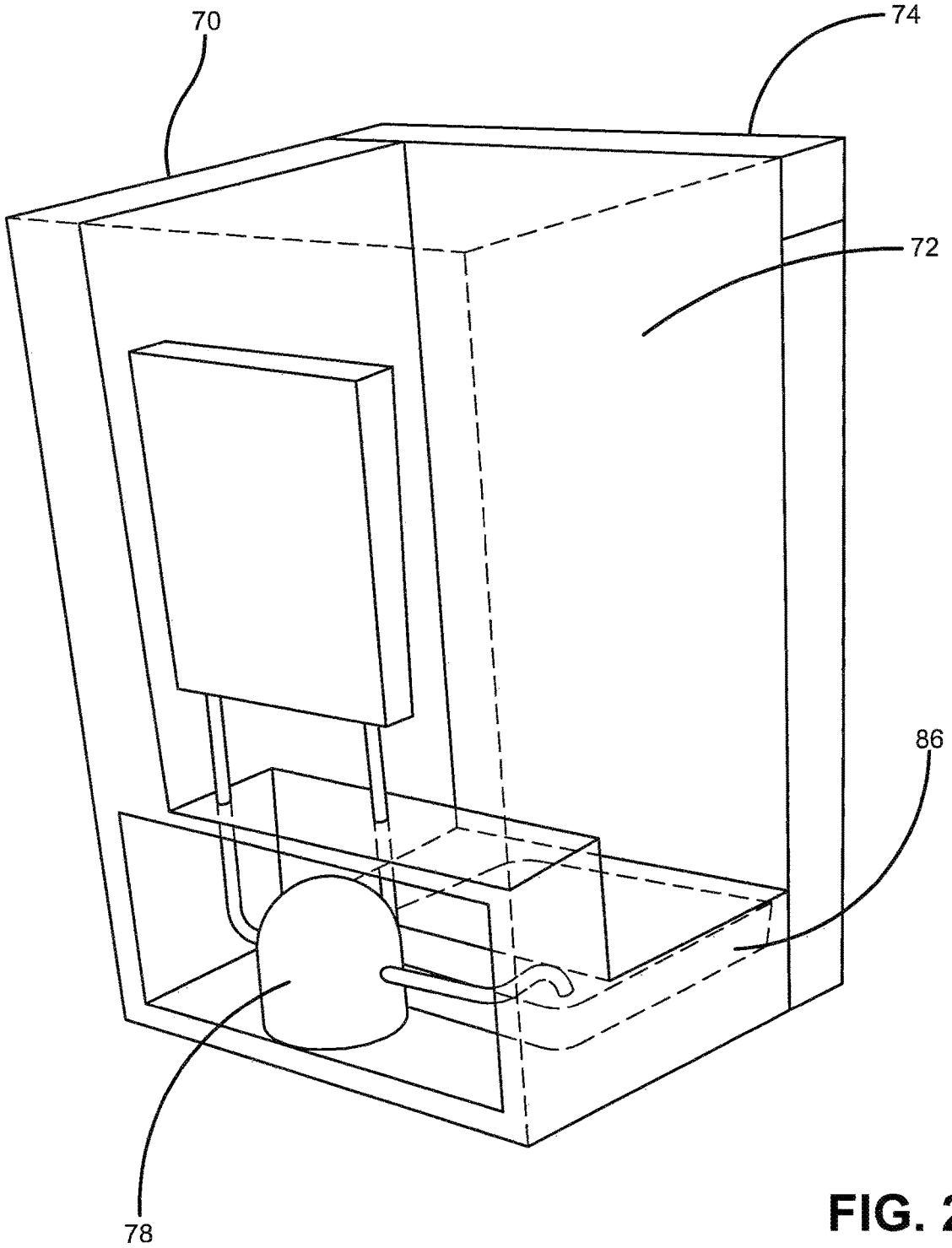
FIG. 26 is isometric schematic view of the refrigerator portion of the appliance unit shown in FIG. 24.
Figure 27:
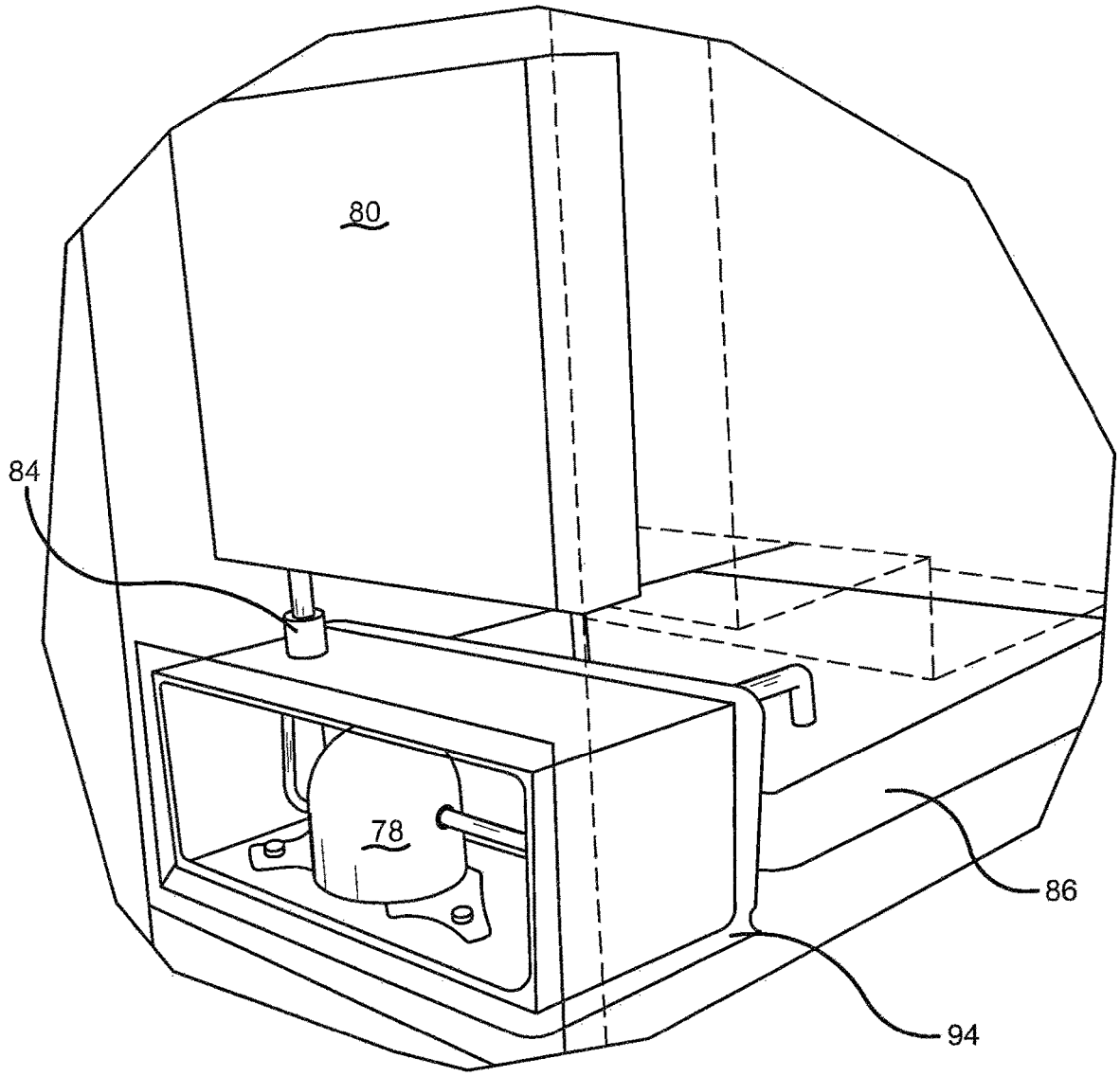
FIG. 27 is an enlarged view of the configuration shown in FIG. 25.

FIGS. 25-27 show schematically an exemplary arrangement that may be used in connection with a compact refrigerator or similar device. Such a compact refrigerator may be part of an appliance like that previously described or alternatively may be a standalone device. The exemplary embodiment described is utilized for purposes of minimizing vibration transmission which may occur as a result of operation of the refrigerant compressor used in connection with the refrigerator. Further the exemplary arrangement is operative to enable more readily repairing the refrigerator by having a removable compressor encasement structure which can be readily fluidly disconnected from components of the refrigerator, removed from the refrigerator body and replaced so as to minimize the repair time and cost associated repairs. FIG. 25 shows a transparent side view of an exemplary refrigerator 68. Refrigerator 68 includes a body 70. Body 70 bounds an interior area 72 in which food or other items to be refrigerated are stored. Interior area 72 has an opening 74. A door 76 is movably mounted in operative connection with the body so as to enable selectively accessing and closing the opening to the interior area.

In the exemplary arrangement the refrigerator includes a compressor 78. The exemplary compressor 78 operates to compress and pump the refrigerant material so as to cool the interior area 72 and transfer the heat therefrom to the surroundings such as the air in the room in which the refrigerator is located.

In the exemplary arrangement the compressor 78 is in operative fluid connection with an evaporator 80. In the exemplary arrangement the evaporator is in or adjacent to the interior area 72 so as to remove heat therefrom. The expanded refrigerant within the evaporator is enabled to be in fluid connection with the compressor through a first fluid conduit 82. Fluid conduit 82 includes at least one disconnectable fluid loss preventing fitting 84. The exemplary fluid loss preventing fitting is operative to enable the first fluid conduit to fluidly be disconnected from the compressor 78 without significant loss of the refrigerant material. This may be accomplished in an exemplary arrangement through a pair of opposed check valves or a similar arrangement that prevents the loss of fluid from either the evaporator or the compressor when the fitting is disconnected. Alternatively other types of fluid loss prevention fittings may be utilized including those with valves which can be manually or automatically actuated therein so as to prevent fluid loss.

In the exemplary arrangement the compressor 78 is in fluid connection with a condenser 86. The condenser 86 is operative to release heat from the refrigerant material and to cause refrigerant vapor to condense. In the exemplary arrangement the condenser is operative to release the heat into the air adjacent to the lower portion of the body 70 of the refrigerator. In the exemplary arrangement the condenser is fluidly connected to the compressor 78 through a fluid conduit 88. Fluid conduit 88 further includes at least one disconnectable fluid loss preventing fitting 90 which may be similar to the fitting types previously discussed.

Of course it should be understood that the exemplary refrigerator includes additional components which are not shown in FIGS. 25-27. These include for example an accumulator, filter dryer, expansion valve and other components of the heat transfer fluid circuit. Such components condition and control the refrigerant flow so as to enable the refrigerant condensed in the condenser to expand in the evaporator in a heat transfer cycle.

In the exemplary arrangement the refrigerator includes a removable encasement 92. Encasement 92 is in operative supporting connection with the compressor 78. Encasement 92 is removable from the interior of the body 70 of the refrigerator when the compressor 78 is fluidly disconnected from the evaporator and the condenser by disconnection of the fittings 84 and 90.

In exemplary arrangements the encasement 92 is in supported connection with the refrigerator body through at least one resilient pad 94. Resilient pad 94 of the exemplary arrangement comprises a resilient shock absorbing pad of rubber or other material that is suitable for vibrationally isolating the encasement from the body of the refrigerator. A further resilient pad 96 extends between the encasement and the liner bounding the interior area 72. The further resilient pad extends generally vertically in the operational position.

The exemplary resilient pads are configured to be of such thickness and to have such vibration absorption properties so as to reduce the vibration which is inherent in the operation of the compressor from being transmitted from the encasement structure to the body of the refrigerator. This reduces the risk of vibration of the items housed within the refrigerator. Such low vibration may be highly desirable for certain types of beverages or other stored items. Further such vibration isolation capabilities may be desirable for structures adjacent to the refrigerator body or that are supported thereon, such as other electrical components of the appliances previously discussed. Further in exemplary arrangements the resilient pads can be configured to engage channels, projections, recesses or other structures of the body so as to avoid the need for metallic or other fasteners to directly extend between the encasement structure and the body of the refrigerator. Such approaches to engagement of the encasement structure and the refrigerator body may facilitate the removal and replacement thereof in the event of compressor failure. As a result, such exemplary arrangements facilitate being able to more readily repair the refrigerator while reducing the adverse effects of vibration which are inherent in the operation of compressors utilized with compact refrigerators. Of course it should be understood that these structures are exemplary and in other arrangements, other approaches may be used.

Thus the exemplary embodiments described achieve improved operation, eliminate difficulties encountered in the use of prior devices and systems and attain the useful results as described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful concepts are not limited to the features shown and described.

It should be understood that features and/or relationships associated with one embodiment can be combined with features and/or relationships of another embodiment. That is, various features and/or relationships from various embodiments can be combined in further embodiments. The inventive scope of the disclosure is not limited to only the embodiments shown or described herein.

Having described the features, discoveries and principles of the exemplary embodiments, the manner in which they are constructed and operated, and the advantages and useful results attained, the new and useful features, devices, elements, arrangements, parts, combinations, systems, equipment, operations, methods, processes and relationships are set forth in the appended claims.

We claim:

1. Apparatus comprising:

a safe adapted to hold valuables, wherein the safe includes a body that bounds an interior area, wherein the body includes an access opening to the interior area, a door movably mounted on the body wherein the door is movable between a closed position, wherein the door closes the access opening, and an open position, wherein at least a portion of the door is disposed from the access opening and enables the interior area to be accessed from outside the body, a lock in operative connection with the door, wherein the lock is changeable between a locked condition in which the lock is operative to hold the door in the closed position, and an unlocked condition in which the door is enabled to be moved from the closed position to the open position, wherein the safe body includes a plurality of wall pieces, including a bottom wall piece, a top wall piece, a first side wall piece, a second side wall piece, and a back wall piece, wherein the access opening is opposite the back wall piece, wherein a first one of the plurality of wall pieces includes an outer bounding wall segment, and an engaging wall segment that extends parallel to the outer bounding wall segment and is disposed within the interior area, wherein the outer bounding wall segment and the engaging wall segment define an elongated slot, wherein a second one of the plurality of wall pieces includes a latching edge portion, wherein the latching edge portion extends in the elongated slot, wherein one of the engaging wall segment and the latching edge portion includes at least one deformable resilient spring tab and the other of the engaging wall segment and the latching edge portion includes at least one recess that is engaged with a respective tab, wherein the engaged at least one tab and at least one recess resist disengagement of the first one and the second one of the wall pieces.

2. The apparatus according to claim 1 wherein a third one of the wall pieces includes a further outer bounding wall segment that extends generally parallel of the outer bounding wall segment, a further engaging wall segment, wherein the further engaging wall segment extends generally parallel of the engaging wall segment, wherein the further outer bounding wall segment and the further engaging wall segment define a further elongated slot, wherein the second one of the wall pieces includes a further latching edge portion, wherein the further latching edge portion is disposed generally opposite of the latching edge portion, wherein the further latching edge portion extends in the further elongated slot, wherein one of the further latching edge portion and the further engaging wall segment includes at least one further deformable resilient spring tab other than the at least one deformable resilient spring tab, and the other of the further latching edge portion and the further engaging wall segment includes at least one further recess other than the at least one recess, wherein the at least one further recess is in engagement with the at least one further deformable resilient spring tab.

3. The apparatus according to claim 2 wherein the engaging wall segment includes an aperture, and the latching edge portion includes a further aperture, wherein a releasable fastener extends in both the aperture and the further aperture.

4. The apparatus according to claim 2 wherein the first one of the wall pieces includes the bottom wall piece, the third one of the wall pieces includes the top wall piece, and the second one of the wall pieces includes one of either the first side wall piece, the second side wall piece, and the back wall piece.

5. The apparatus according to claim 4 wherein the bottom wall piece includes first and second bottom bounding wall side segments, wherein the first bottom bounding wall side segment is at an opposed lateral side of the bottom wall piece from the second bottom bounding wall segment, first and second bottom engaging wall side segments, wherein the first bottom engaging wall side segment is adjacent the first bounding wall side segment, wherein the first bottom bounding wall side segment and the first bottom engaging wall side segment define a first elongated bottom side slot, and wherein the second bottom engaging wall side segment is adjacent the second bottom bounding wall side segment, wherein the second bottom bounding wall side segment and the second bottom engaging wall side segment define a second elongated bottom side slot, a back bottom bounding wall segment at a back side of the bottom wall piece, a back bottom engaging wall segment adjacent the back bottom bounding wall segment, which back bottom bounding wall and back bottom engaging wall segment define a back bottom slot, wherein a lower latching edge portion of the first side wall piece is engaged in the first elongated bottom side slot, a lower latching edge portion of the second side wall piece is engaged in the second elongated bottom side slot, a lower latching edge portion of the back wall piece is engaged in the back bottom slot, wherein each of the first and second bottom engaging wall side segments and the back bottom engaging wall segment of the bottom wall piece includes at least one respective recess, and each of the lower latching edge portions of the first side wall piece, the second side wall piece, and the back wall piece include at least one respective deformable resilient spring tab, wherein the at least one deformable resilient spring tab of the first side wall piece is engaged in the at least one recess of the first bottom engaging wall side segment, and wherein the at least one deformable resilient spring tab of the second side wall piece is engaged in the at least one recess of the second bottom engaging wall side segment, and wherein the at least one deformable resilient spring tab of the back wall piece is engaged in the at least one recess of the back bottom engaging wall segment.

6. The apparatus according to claim 5 wherein the top wall piece includes two top bounding wall side segments at opposed lateral sides thereof, two top engaging wall side segments, one of which is adjacent each top bounding wall side segment and each of which top bounding wall side segment and top engaging wall segment define a respective elongated top side slot, a back top bounding wall segment at a back side thereof, a back top engaging wall segment adjacent the back top bounding wall segment, which back top bounding wall segment and back top engaging wall segment define a back top slot, wherein an upper latching edge portion of the first side wall piece is engaged in one of the elongated top side slots, and an upper latching edge portion of the second side wall piece is engaged in another of the top side slots, and an upper latching edge portion of the back wall piece is engaged in the back top slot, wherein each of the top engaging wall side segments and back top engaging wall segment of the top wall piece includes at least one respective further recess, and each of the upper latching edge portions of the first side wall piece, the second side wall piece, and the back wall piece each include a respective at least one further deformable resilient spring tab, wherein each respective further deformable resilient spring tab is engaged in a respective further recess.

7. The apparatus according to claim 6 wherein the lock includes a bolt, wherein the bolt is selectively movable between an extended position and a retracted position, wherein in the locked condition the bolt is in the extended position and in the unlocked condition the bolt is in the retracted position, wherein one of the first side wall piece and the second side wall piece includes a strike, wherein the strike includes a strike opening, wherein in the closed position of the door closing the access opening, and in the locked condition of the lock wherein the bolt is in the extended position and extends in the strike opening, the door is held in the closed position.

8. The apparatus according to claim 7 wherein the door includes an inner door face, wherein the inner door face includes a strike recess, wherein in the closed position of the door the strike extends in the strike recess.

9. The apparatus according to claim 7 wherein the bottom wall piece includes a bottom shelf, wherein the bottom shelf extends generally horizontally in an operative position of the safe, wherein the bottom shelf includes a bottom hinge pin opening, wherein the top wall piece includes a top shelf, wherein the stop shelf extends generally horizontally in the operative position of the safe, wherein the top shelf includes a top hinge pin opening, wherein the top hinge pin opening and the bottom hinge pin opening are aligned along an axis, wherein the door is in operative connection with a top hinge pin and a bottom hinge pin, wherein the top hinge pin is operatively engaged in the top hinge pin opening and the bottom hinge pin is operatively engaged in the bottom hinge pin opening, wherein the door is rotatable about the axis.

10. The apparatus according to claim 9 wherein each of the top hinge pin and the bottom hinge pin are selectively extendable and retractable from the door, whereby the door in the open position and disposed from closing the access opening, can be engaged with and disengaged from the safe body.

11. The apparatus according to claim 10 wherein the door inner face includes a hinge pin recess, wherein the top hinge pin and the bottom hinge pin can be selectively moved between respective extended and retracted positions from the door through engagement thereof in the hinge pin recess.

12. The apparatus according to claim 11 wherein each of the top hinge pin and the bottom hinge pin are in operative connection with at least one spring, wherein the at least one spring biases the top hinge pin and the bottom hinge pin toward the respective extended positions.

13. The apparatus according to claim 9 wherein the bottom shelf includes a bottom shelf stop, wherein the bottom shelf stop extends upward when the safe is in the operative position, and the top shelf includes a top shelf stop, wherein the top shelf stop extends downward when the safe is in the operative position, wherein both stops are operative to prevent the door in the closed position from being moved further into the interior area.

14. The apparatus according to claim 13 wherein the bottom shelf stop comprises a bottom turned edge of the bottom shelf, and the top shelf stop comprises a top turned edge of the top shelf, wherein each of the top turned edge and the bottom turned edge extend substantially an entire width of the access opening.

15. The apparatus according to claim 13 wherein each at least one deformable resilient spring tab comprises a punched opening extending in a respective wall portion, wherein the opening extends generally perpendicular to the wall portion.

16. The apparatus according to claim 15 wherein each at least one deformable resilient spring tab includes a catch surface at a first end, wherein the catch surface is sheared and disposed away from the wall portion in the area of the catch surface, a smooth rounded second end surface opposed of the first end surface, and a pair of rounded side surfaces, wherein the second end surface and the side surfaces are continuous with the wall portion, wherein the catch surface is configured to engage an edge bounding the respective recess in which the tab is engaged.

17. The apparatus according to claim 15 wherein the wall pieces and the door are configured to be assembled to form the safe body and after safe body assembly to have the door attached to the body, manually and without the use of tools.

18. The apparatus according to claim 15 wherein the wall pieces and the door are configured to be in separated flat stacked condition prior to assembly into the safe body.

19. The apparatus according to claim 18 wherein the safe includes at least one safe circuit, at least one audible annunciator, wherein the at least one audible annunciator is in operative connection with the at least one safe circuit, at least one electrically conductive material mesh in operative connection with the safe body, wherein the at least one mesh is in operative connection with the at least one safe circuit, wherein a change in integrity of the at least one mesh is operative to cause the at least one annunciator to provide an output audible alarm.

20. The apparatus according to claim 18 wherein the safe circuit includes at least one safe circuit, at least one conductive trace, wherein the at least one conductive trace is in operative connection with at least one of the body and the door, wherein the at least one conductive trace is in operative connection with the at least one safe circuit, at least one audible annunciator, wherein the at least one audible annunciator is in operative connection with the at least one safe circuit, wherein a break in the at least one conductive trace is operative to cause the at least one annunciator to provide an output audible alarm.

21. The apparatus according to claim 18 wherein the safe includes at least one safe circuit, at least one audible annunciator, wherein the at least one audible annunciator is in operative connection with the at least one safe circuit, at least one position sensor, wherein the at least one position sensor is operative to detect movement of the safe, wherein the at least one position sensor is in operative connection with the at least one safe circuit, wherein the at least one position sensor responsive to sensing movement of the safe is operative to cause the at least one annunciator to provide an output audible alarm.

22. The apparatus according to claim 15 wherein the safe body is configured to be included in an appliance unit in intermediate stacked relation between a refrigerator and a microwave oven.

23. The apparatus according to claim 22 wherein at least one component of the safe receives power from at least one of the refrigerator and the microwave oven.

24. The apparatus according to claim 22 wherein the interior area includes a power connector configured for charging a battery of a mobile device.

25. Apparatus comprising:

a safe, wherein the safe includes a body, wherein the body bounds an interior area, wherein the body includes an access opening to the interior area, a door movably mounted on the body, wherein the door is movable between a closed position, wherein in the closed position the door closes the access opening, and an open position, wherein in the open position at least a portion of the door is disposed away from the access opening, a lock in operative connection with the door, wherein the lock is changeable between a locked condition in which the lock is operative to hold the door in the closed position, and an unlocked condition in which the door is enabled to be moved between the closed position and the open position, wherein the safe body includes a plurality of wall pieces, including a bottom wall piece, a top wall piece, a first side wall piece, a second side wall piece, and a back wall piece, wherein a first one of the plurality of wall pieces includes an outer bounding wall segment, and an engaging wall segment that extends parallel to the outer bounding wall segment, wherein the outer bounding wall segment and the engaging wall segment define an elongated slot, wherein a second one of the plurality of wall pieces includes a latching edge portion, wherein the latching edge portion extends in the elongated slot, wherein one of the engaging wall segment and the latching edge portion includes at least one deformable resilient spring tab and the other of the engaging wall segment and the latching edge portion includes at least one recess, wherein each respective at least one tab is engaged with a respective recess, wherein the engaged at least one tab and at least one recess are operative to resist disengagement of the first one of the wall pieces and the second one of the wall pieces.

26. The apparatus according to claim 25 wherein the door includes a top hinge pin and a bottom hinge pin, wherein the top hinge pin and the bottom hinge pin each extend along a common axis and are each selectively movably extendable and retractable on the door, wherein the bottom wall piece includes a bottom hinge pin opening, wherein the top wall piece includes a top hinge pin opening, wherein the top hinge pin is extended into engagement with the top hinge pin opening and the bottom hinge pin is extended into engagement with the bottom hinge pin opening, wherein the door is rotatably movable about the axis between the open position and the closed position.

27. The apparatus according to claim 25 wherein each at least one deformable resilient spring tab comprises a punched opening extending in a respective wall portion, wherein the opening extends generally perpendicular to the wall portion.

28. Apparatus comprising:

a safe, wherein the safe includes a body, wherein the body bounds an interior area, wherein the body includes an access opening to the interior area, a door movably mounted on the body, wherein the door is movable between a closed position, wherein in the closed position the door closes the access opening, and an open position, wherein in the open position at least a portion of the door is disposed away from the access opening, a lock in operative connection with the door, wherein the lock is changeable between a locked condition in which the lock is operative to hold the door in the closed position, and an unlocked condition in which the door is enabled to be moved between the closed position and the open position, wherein the safe body includes a plurality of wall pieces, including a bottom wall piece, a top wall piece, a first side wall piece, a second side wall piece, and a back wall piece, wherein a first one of the plurality of wall pieces includes an outer bounding wall segment, and an engaging wall segment, wherein the engaging wall segment extends parallel to the outer bounding wall segment and is disposed within the interior area, wherein the outer bounding wall segment and the engaging wall segment define an elongated slot, wherein a second one of the plurality of wall pieces includes a latching edge portion, wherein the latching edge portion extends in the elongated slot, wherein one of the engaging wall segment and the latching edge portion includes at least one tab, wherein the at least one tab extends outward from and perpendicular to the respective one of the engaging wall segment and the latching edge portion, and wherein the other one of the engaging wall segment and the latching edge portion includes at least one recess that extends in the respective other one of the engaging wall segment and the latching edge portion, wherein each respective at least one tab is resiliently engaged within a respective recess, wherein the engaged at least one tab and at least one recess are operative to resist disengagement of the first one and the second one of the wall pieces.

* * * * *